US009172174B2

(12) United States Patent
Tsai

(10) Patent No.: US 9,172,174 B2
(45) Date of Patent: Oct. 27, 2015

(54) ELECTRICAL CONNECTION SOCKET HAVING INSULATING SEATS STACKED TOGETHER

(71) Applicant: Chou Hsien Tsai, Taipei Hsien (TW)

(72) Inventor: Chou Hsien Tsai, Taipei Hsien (TW)

( * ) Notice: Subject to any disclaimer, the term of this patent is extended or adjusted under 35 U.S.C. 154(b) by 151 days.

(21) Appl. No.: 13/939,751

(22) Filed: Jul. 11, 2013

(65) Prior Publication Data

US 2014/0017951 A1 Jan. 16, 2014

(30) Foreign Application Priority Data

| | | |
|---|---|---|
| Jul. 12, 2012 | (CN) | 2012 2 0337608 |
| Sep. 24, 2012 | (CN) | 2012 2 0488089 |
| Dec. 19, 2012 | (CN) | 2012 2 0706237 |

(51) Int. Cl.

| | |
|---|---|
| ***H01R 25/00*** | (2006.01) |
| ***H01R 27/02*** | (2006.01) |
| ***H01R 31/00*** | (2006.01) |
| ***H01R 33/00*** | (2006.01) |
| ***H01R 13/516*** | (2006.01) |
| ***H01R 13/514*** | (2006.01) |
| *H01R 13/659* | (2011.01) |
| *H01R 24/64* | (2011.01) |

(52) U.S. Cl.

CPC ..... *H01R 13/516* (2013.01); *H01R 13/514* (2013.01); *H01R 13/659* (2013.01); *H01R 24/64* (2013.01)

(58) Field of Classification Search

CPC .. H01R 13/516; H01R 13/659; H01R 13/514; H01R 24/64

USPC ..... 439/638, 660, 541.5, 607.04, 607.35, 439/607.01

See application file for complete search history.

(56) References Cited

U.S. PATENT DOCUMENTS 7,922,525 B2 * 4/2011 Lee ..... 439/541.5

* cited by examiner

*Primary Examiner* — Javaid Nasri

(74) *Attorney, Agent, or Firm* — Pro-techtor International Services; Ian Oglesby

(57) ABSTRACT

An electrical connection socket includes: at least two insulating seats each having a base and terminals to form at least one contact interface, wherein one end of the base of at least one insulating seat is projected to form at least one tongue, the base is thicker than the tongue, the tongue has the contact interface, and the bases of the at least two insulating seats are stacked; a metal casing covering the at least two insulating seats and having one end formed with an opening, the metal casing at least directly resting against one of the insulating seats; and at least two connection slots disposed in the metal casing, wherein the tongue is disposed in a connection slot, and the contact interface to be electrically connected to a plug is disposed in each connection slot.

20 Claims, 30 Drawing Sheets

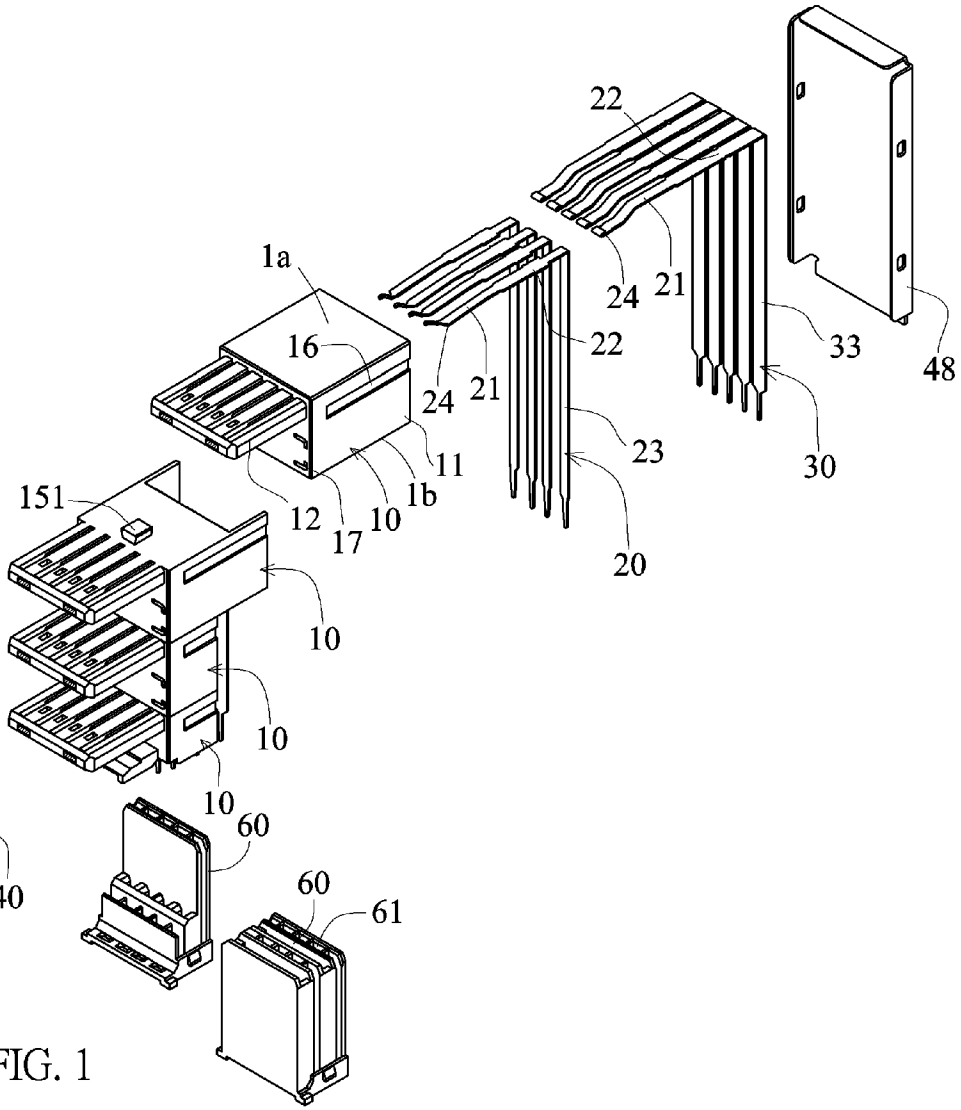
FIG. 1
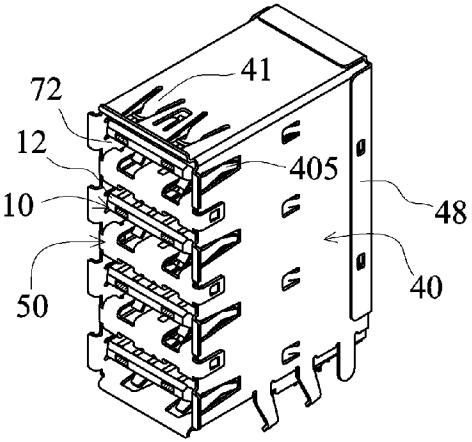
FIG. 2
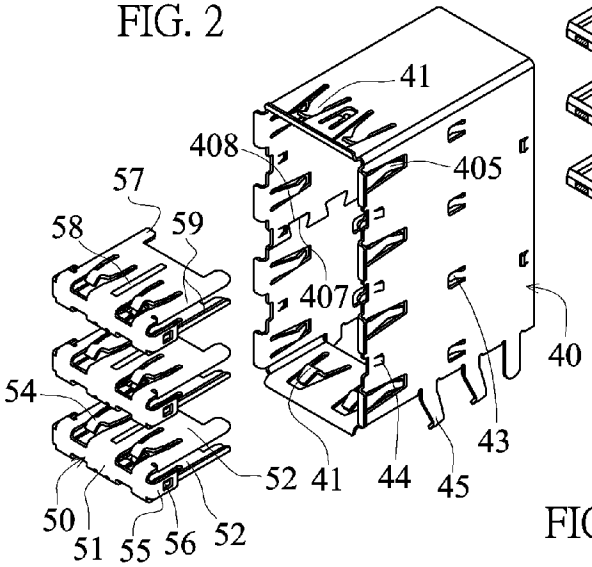

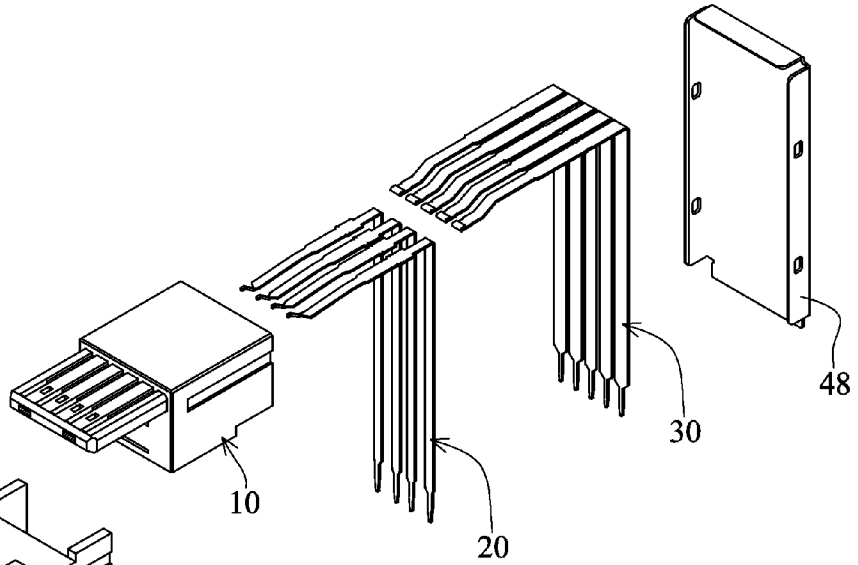
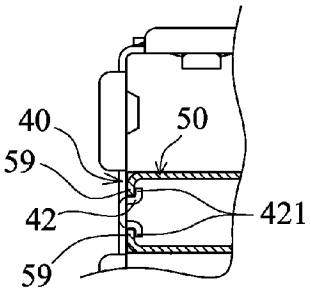
FIG. 8A
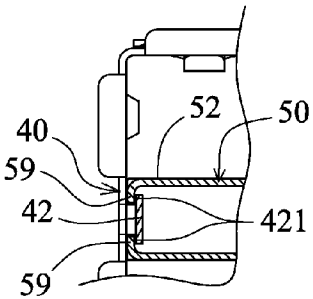
FIG. 8
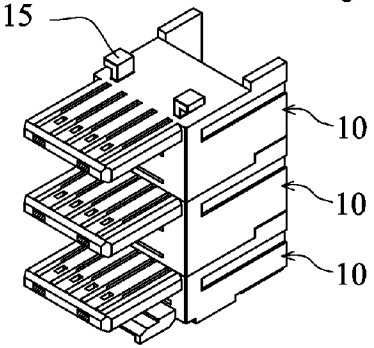
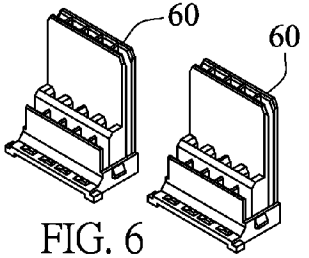
FIG. 6
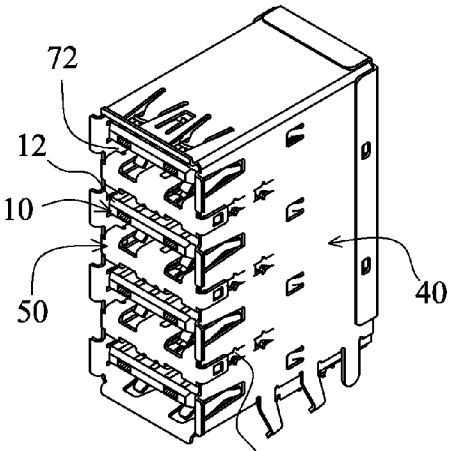
FIG. 7
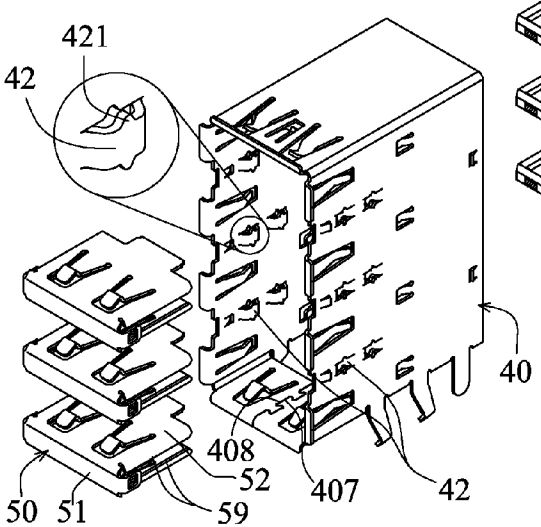

ELECTRICAL CONNECTION SOCKET HAVING INSULATING SEATS STACKED TOGETHER

BACKGROUND OF THE INVENTION

1. Field of the Invention

The invention relates to an electrical connector, and more particularly to a multilayer electrical connection socket.

2. Related Art

The current electronic products are gradually diversified in the use functions and the multimedia applications, and the functions are enhanced. So, various electrical connectors have to be disposed on the motherboard for the connection to the required data or multimedia. In the spatial allocation, the same electrical connectors or different electrical connectors have the requirements of stacked arrangements. That is, stacked connection slots have to be disposed in the same metal casing.

The conventional multilayer USB 3.0 socket structure includes a plastic frame for covering stacked insulating seats. The middle holding plates can be disposed in the plastic frame to divide the space into stacked slots. So, the structure is more complicated and the manufacturing cost is increased.

SUMMARY OF THE INVENTION

A main object of the invention is to provide an electrical connection socket having a metal casing, in which stacked connection slots are formed. With the insulating seats disposed in the stacked manner, the overall structure is simplified, and the manufacturing cost is decreased.

Another object of the invention is to provide an electrical connection socket having a metal casing, in which stacked connection slots are formed. The slots include more than two different contact interfaces to be electrically connected to more than two different plugs, thereby achieving the convenience in use.

Still another object of the invention is to provide an electrical connection socket including a metal casing, in which stacked connection slots are formed, wherein a separating member, which is made of a metal material and formed with elastic snaps, is directly used for separation, thereby simplifying the structure.

To achieve the above-identified objects, the invention provides an electrical connection socket comprising: at least two insulating seats each having a base, wherein and at least one row of terminals is assembled into each of the at least two insulating seats, wherein the terminal has an extension, a fixing portion and a pin, the fixing portion is fixed to a corresponding one of the at least two insulating seats, the extension is connected to one end of the fixing portion and has a contact, and the pin is connected to the fixing portion and extends out of the insulating seat, the contacts of the at least one row of terminals form at least one contact interface, wherein one end of the base of at least one of the insulating seats is projected to form at least one tongue, the base is thicker than the tongue, the tongue has the at least one contact interface, and the bases of the at least two insulating seats are stacked; a metal casing covering the at least two insulating seats, wherein one end of the metal casing is formed with an opening, and the metal casing at least directly rests against one of the insulating seats; and at least two connection slots disposed in the metal casing. The tongue is disposed in one of the connection slots, and the contact interface is disposed in each of the connection slots so that the contact interface is electrically connected to a plug. An inserting port of the connection slot is exposed from the opening of the metal casing.

According to the insulating seats directly disposed in a stacked manner, the overall structure is simplified and the manufacturing cost is decreased.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

FIG. 1 is a pictorially exploded view of a first embodiment of the invention.

FIG. 2 is a pictorially assembled view of the first embodiment of the invention.

FIG. 6 is a pictorially exploded view showing insulating seats of a second embodiment of the invention.

FIG. 7 is a pictorially assembled view showing the insulating seats of the second embodiment of the invention.

FIG. 8 is a partially cross-sectional front view of the second embodiment of the invention.

FIG. 8A is a partially cross-sectional front view of the second embodiment of the invention.

DETAILED DESCRIPTION OF THE INVENTION

Figure 5:
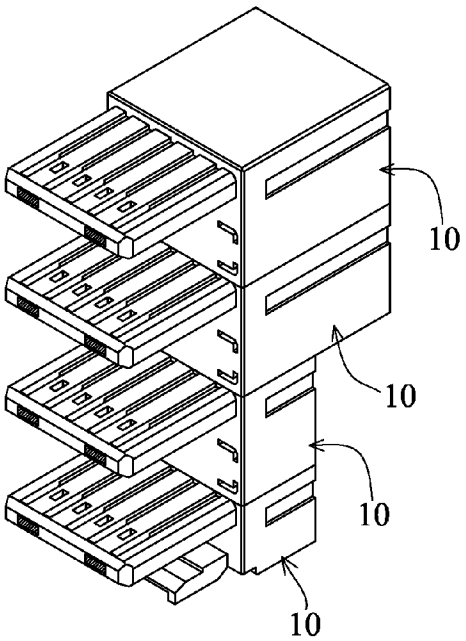
FIG. 5 is a pictorially assembled view showing the four insulating seats of the first embodiment of the invention.
Figure 4:
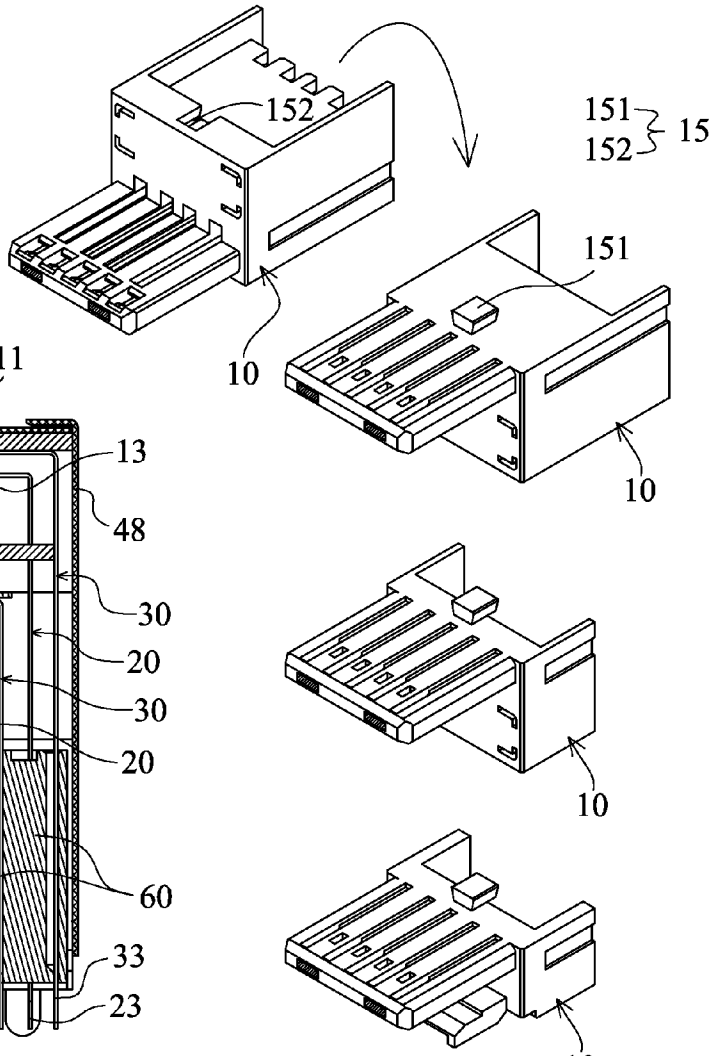
FIG. 4 is a pictorially exploded view showing four insulating seats of the first embodiment of the invention.
Figure 3:
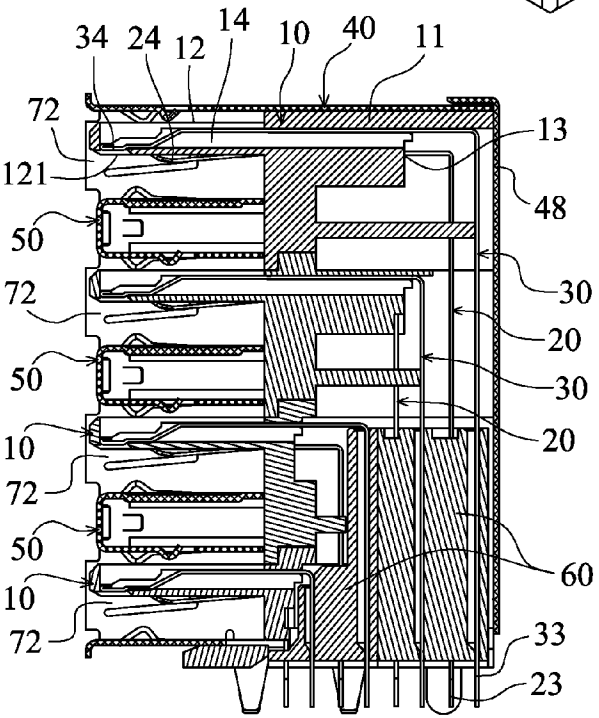
FIG. 3 is a cross-sectional side view of the first embodiment of the invention.

The present invention will be apparent from the following detailed description, which proceeds with reference to the accompanying drawings, wherein the same references relate to the same elements.

Referring to FIGS. 1 to 5, this embodiment is a multilayer USB 3.0 socket having four layers disposed vertically and including four insulating seats 10, two insulating rear covers 60, a metal casing 40 and three separating members 50.

The four insulating seats 10 are formed by way of plastic injection molding. Each of the insulating seats 10 has a base 11, a tongue 12, one row of four first terminal slots 13, one row of five second terminal slots 14 and an engaging structure 15. The base 11 is thicker than the tongue 12. The tongue 12 projects beyond the front end of the base 11. The bottom surface of the tongue 12 has a jointing surface 121. The one row of first and second terminal slots 13, 14 extend from the rear end of the base 11 to a location close to the front end of the tongue 12. The engaging structure 15 has an engaging block 151 on the top surface of the base 11 and a slot 152 on the bottom surface of the base 11. The bases 11 of the four insulating seats 10 can be stacked, directly connected to each other and positioned in the vertical direction. In addition, each of two sides of the base 11 is formed with a groove 16, and the front end of the base 11 has a fitting structure 17 in the form of four symmetrical L-shaped slots. In this embodiment, each of the bases 11 has a first surface 1*a* and a second surface 1*b* opposite to the first surface 1*a*, the second surface 1*b* of one base 11 is directly connected to the other base 11, and the first surface 1*a* and the second surface 1*b* of the base 11 are integrally formed.

In addition, the front ends of the bases 11 of the insulating seats 10 of the second to fourth layers do not correspond to the convex portion of the tongue 12 in the vertical direction.

One row of four first terminals 20 and one row of five second terminals 30 are assembled into each of the insulating seats 10. The one row of first terminals 20 is assembled and fixed into the one row of first terminal slots 13. The one row of second terminals 30 are assembled and fixed into the one row of second terminal slots 14. The first terminal 20 integrally has an extension 21, a fixing portion 22 and a pin 23. The fixing portion 22 is fixed to the first terminal slot 13. The extension 21 is connected to the front end of the fixing portion 22, extends frontwards and is bent to form a projecting contact 24. The pin 23 extends out of the insulating seat 10 and extends downwards. The extensions 21 of the one row of first terminals 21 are vertically elastically movable, and the contacts 24 of the one row of first terminals 21 project beyond the jointing surface 121 of the tongue 12. The second terminal 30 integrally has an extension 31, a fixing portion 32 and a pin 33. The fixing portion 32 is fixed to the second terminal slot 14. The extension 31 is connected to the front end of the fixing portion 32, extends frontwards and has a projecting contact 34. The contact 34 is exposed from the jointing surface 121. The pin 33 extends out of the insulating seat 10 and extends downwards. The extensions 31 of the one row of second terminals rest against the tongue and are not elastically movable. The contact 34 and the contact 24 of the first terminal 20 are disposed on the same surface, and the contact 34 is disposed in front of the contact 24. The contacts 24 of the one row of first terminals and the contacts 34 of the second terminals form the USB 3.0 contact interface.

Each of the two insulating rear covers 60 rests against the rear end of the four insulating seats 10 and has four rows of through holes 61 arranged in the vertical direction, so that the pins 23 and 33 of the one row of first and second terminals of the four insulating seats 10 pass through for positioning.

The metal casing 40 covers the four insulating seats 10. The metal casing 40 is a metal sheet pressed and bent to form integrally connected top, bottom, left and right circumferential surfaces, and is connected and locked together on only one side to form a housing. That is, the left side surface is a jointing surface. The left side surface has dovetail-shaped engaging block 407 and slot 408 engaging with each other. The one end of the metal sheet other than the circumferential surfaces is formed with an opening. That is, the front end of the housing is opened to form the opening. Each of the top and bottom surfaces of the metal casing integrally has two inwardly projecting elastic snaps 41. Each of the middle sections of the left and right surfaces of the metal casing integrally has four vertically arranged inwardly projecting elastic inverse snaps 43. Each of the front sections of the left and right surfaces of the metal casing integrally has three vertically arranged outwardly projecting elastic inverse snaps 44 and four inwardly projecting elastic grounding sheets 405. Each of the bottom ends of the left and right surfaces of the metal casing has two board connecting elements 45. The four elastic inverse snaps 43 snap to the slots 16 on the left and right sides of the four insulating seats 10 to prevent the four insulating seats 10 from moving back. In addition, a rear metal cover 48 snaps to the rear end of the metal casing 40.

The three separating members 50 are disposed in the metal casing 40. The separating member 50 is a metal plate bent to form a middle plate 51 and two side plates 52. The two side plates 52 are separated from each other by a space, and the rear ends of the side plates 52 are open ends. Each of the two side plates 52 has at least two outwardly projecting elastic snaps 54. Each of two sides of the middle plate 51 has a snap sheet 55 having a snap portion, which is an engagement hole 56. Each of two sides of the two side plates 52 is formed with a bent portion 59. The bent portions 59 are close to each other. The bent portion 59 is formed with the structure of perpendicular corner edges to increase the structure strength of each of the two side plates 52. Each of the two side plates 52 is formed with a projecting rib 58 projecting toward the location between the two side plates so as to increase the plate surface strength. Each of two sides of open ends of the two side plates is formed with an L-shaped engaging sheet 57. The engaging sheets 57 of the three separating members 50 are fixed to the fitting structures 17 of the bases of the second to fourth layers of three insulating seats 10 in the front-to-rear direction. The two side plates 55 fit with two sides of the metal casing 40. The elastic inverse snaps 44 on two sides of the metal casing 40 snap to the engagement holes 56 of the two snap sheets 55. The three separating members 50 divide the metal casing 40 into four USB 3.0 connection slots 72. Each tongue is disposed in one USB 3.0 connection slot 72. The top, bottom, left and right circumferential surfaces of each USB 3.0 connection slot 72 are metal surfaces. The left and right surfaces have elastic grounding sheets 405, and the top and bottom surfaces have elastic snaps 41(54). A USB 3.0 plug can be inserted into each USB 3.0 connection slot 72.

The inserting ports of the four USB 3.0 connection slots 72 of this embodiment face frontwards. One surface of each tongue 12 exposing the contact is horizontal and extends frontwards.

According to the above-mentioned description, the embodiment has the following advantages.

First, the insulating seats 10 are directly stacked together without being fit and connected with a plastic frame. So, the overall structure is simplified, and the manufacturing cost is decreased.

Second, only one tongue 12 is projected from the front end of the base 11 without the provision of the convex portion to be fit between the top and bottom plates of the separating member 50. That is, the space below the tongue is open. Thus, when the insulating seat is manufactured by way of plastic molding, de-molding of top and bottom molds may be easily adopted.

3. The metal separating member 50 is directly provided for the division and is formed with the elastic snap 54, so that the structure is simplified.

Referring to FIGS. 6 to 8, the second embodiment of the invention is substantially the same as the first embodiment except for the following differences. Each of front sections of two sides of the metal casing 40 is formed with three vertically arranged inwardly projecting structures 42 snapping between the two side plates 52 of the three separating members 50. Each inwardly projecting structure 42 extends horizontally and has a hook portion 421. The hook portion 421 has bumps projecting upwards and downwards. The bent portions 59 of the two side plates 52 of the separating member 50 rest against and snap to the inwardly projecting structures 42 in the vertical direction, and hook and restrict the hook portions 421 in the left-to-right direction. Thus, the two side plates 52 of the separating member 50 are rested and supported by the inwardly projecting structures 42 in the vertical direction to have the good strength. The metal casing 40 is hooked by the bent portions 59 in the left-to-right direction to prevent the left and right surfaces from expanding and deformation by an external force. In addition, the engaging structure 15 is in the form of the hook.

As shown in FIG. 8A, the inwardly projecting structure 42 may also be two upward and downward hooks 421 formed by prodding and pressing the plate surface.

Figure 9:
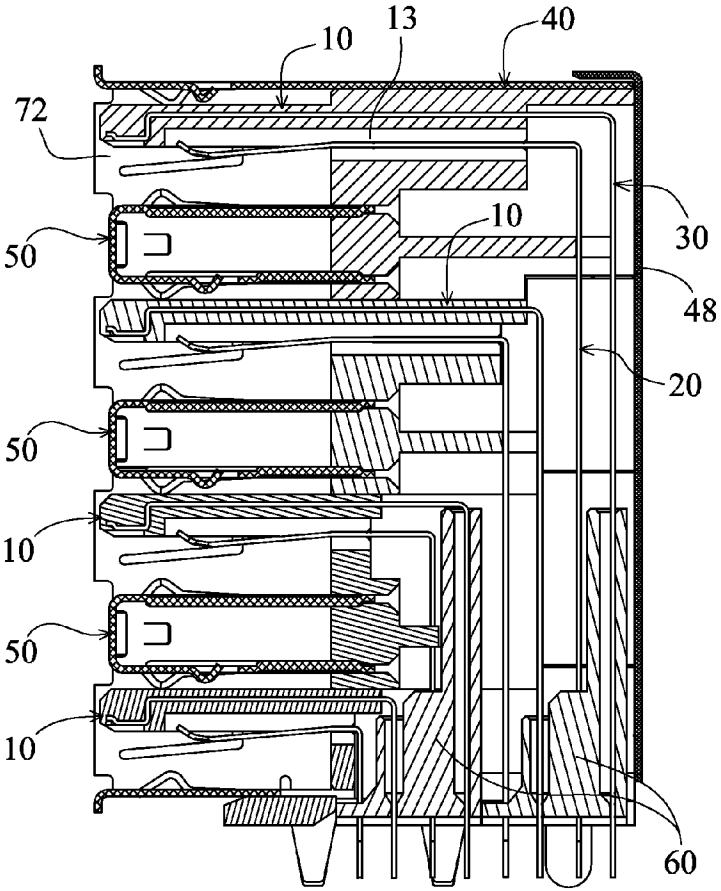
FIG. 9 is a cross-sectional side view showing a third embodiment of the invention.

As shown in FIG. 9, the third embodiment of the invention is substantially the same as the first embodiment except that the one row of second terminals 30 and the insulating seat 10 are concurrently embedded and injected.

Figure 11:
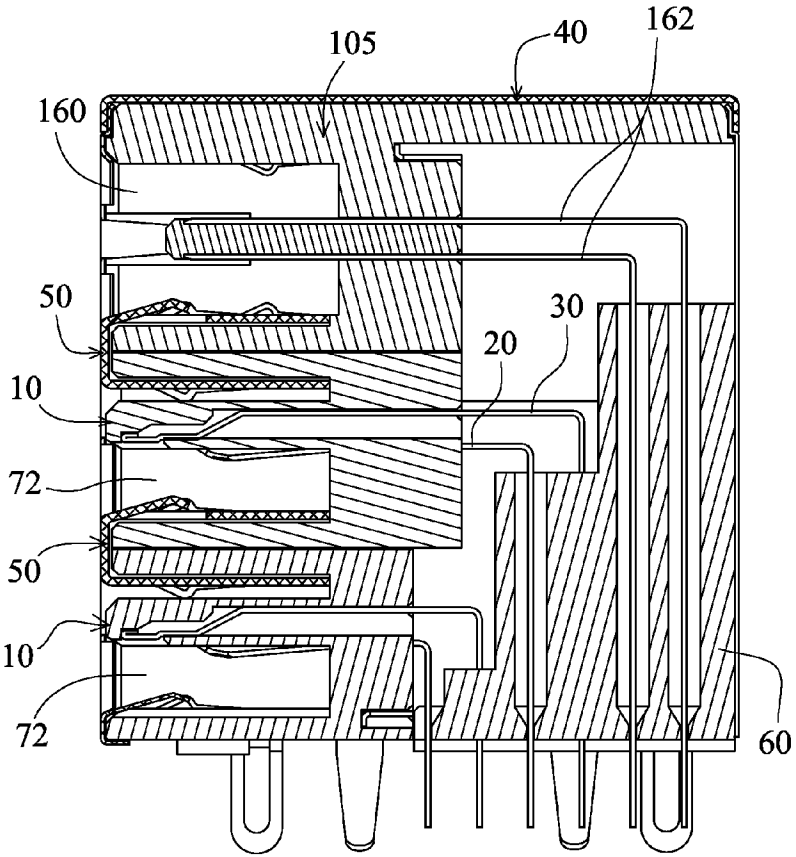
FIG. 11 is a cross-sectional side view showing the fourth embodiment of the invention.
Figure 10:
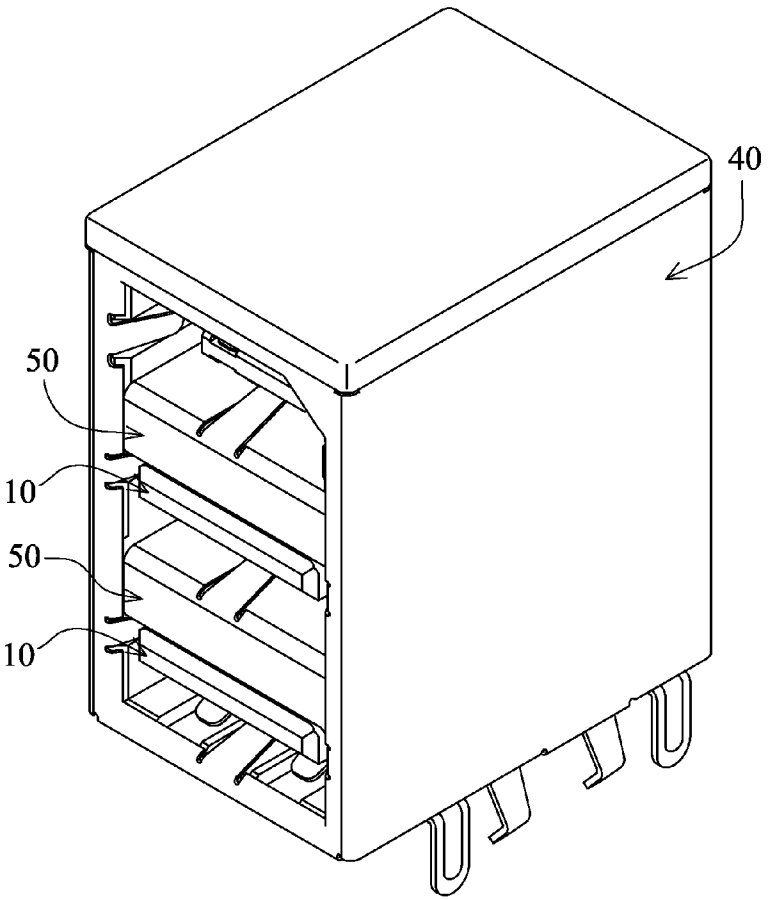
FIG. 10 is a pictorial view of a fourth embodiment of the invention.

As shown in FIGS. 10 and 11, the fourth embodiment of the invention is a dual-layer USB 3.0 socket disposed between two 1394 sockets. The two insulating seats 10 and the two separating members 50 are substantially the same as those of the first embodiment except for the following differences. Each of the two insulating seats 10 is integrally formed with a USB 3.0 connection slot 72. The topmost plastic insulating seat 105 has a 1394 connection slot 160 and two rows of terminals 162 that are not elastically movable. The circumferential walls of the USB 3.0 connection slot 72 and the 1394 connection slot 160 are plastic walls. The front, left and right surfaces of the metal casing 40 are integrally covered with a metallic upper cover 419, and the front plate surface of the metal casing 40 is formed with openings.

Figures 12, 13:
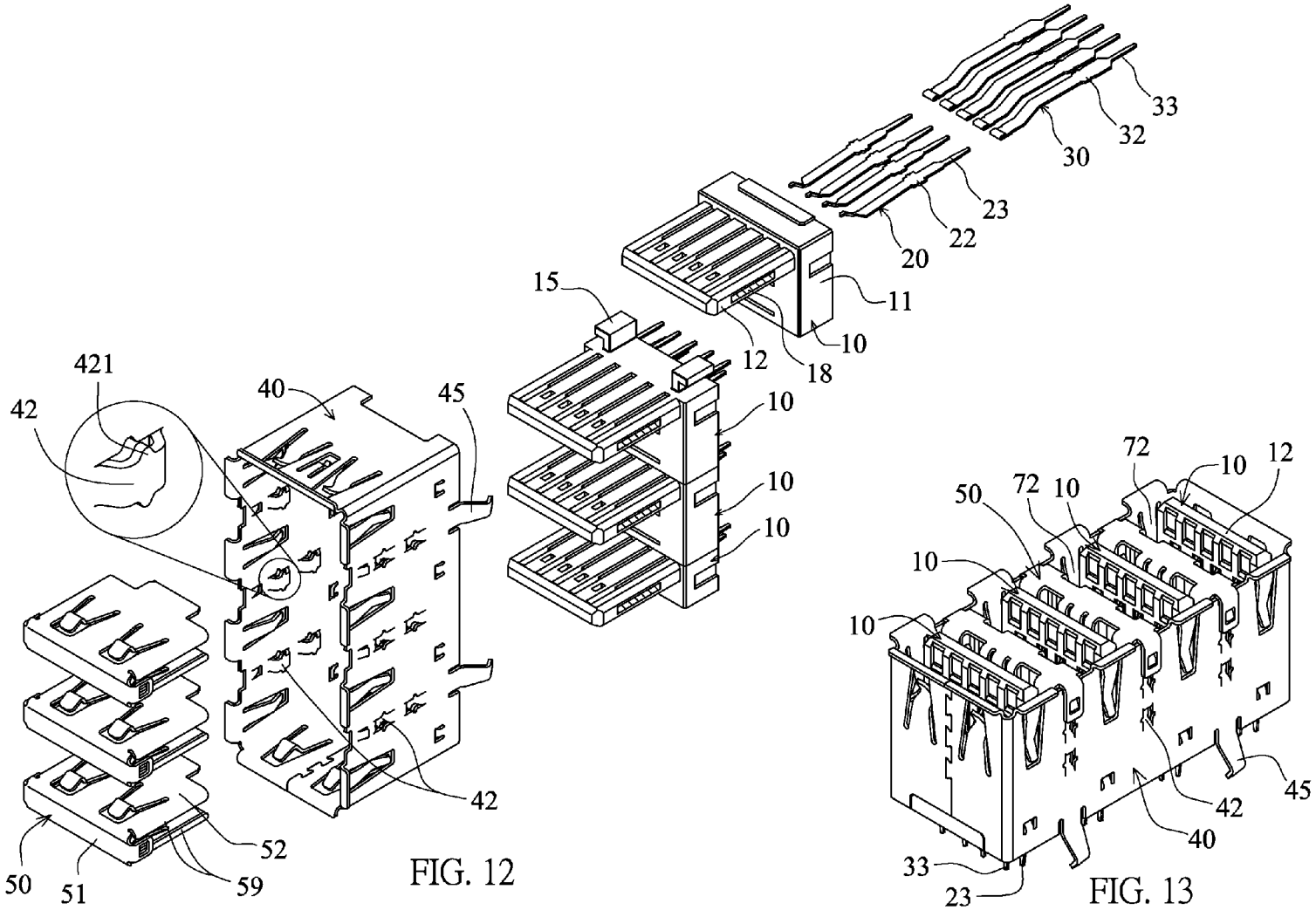
FIG. 12 is a pictorially exploded view showing an insulating seat of a fifth embodiment of the invention.
FIG. 13 is a pictorially assembled view showing the insulating seat of the fifth embodiment of the invention.

As shown in FIG. 12, the fifth embodiment of the invention is a four-layer USB 3.0 socket with an opening facing upwards and is substantially the same as the second embodiment except for the following differences. The metal casing 40 has the open rear end and has four board connecting elements 45. The pins 23, 33 of the first and second terminals horizontally extend backwards. As shown in FIG. 13, when the electrical connection socket is rotated by 90 degrees so that the pins 23, 33 of the one row of first and second terminals of the four insulating seats 10 and the four board connecting elements 45 are disposed below the metal casing 40, the four insulating seats 10 are transversally stacked, the four USB 3.0 connection slots 72 have upward inserting ports, and the surfaces of the four tongues 12 exposing the contacts are vertical and extend upwards.

Figure 15:
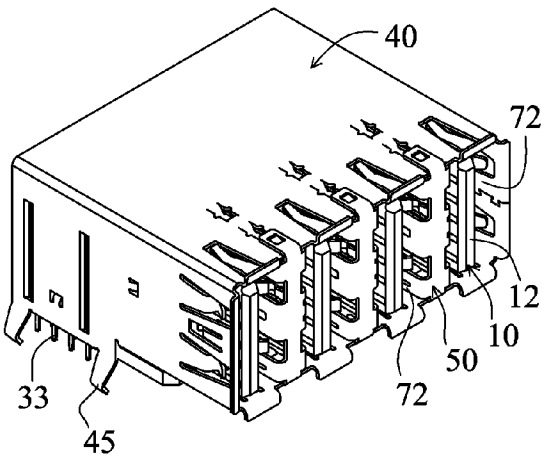
FIG. 15 is a pictorially assembled view showing the insulating seat of the sixth embodiment of the invention.
Figure 14:
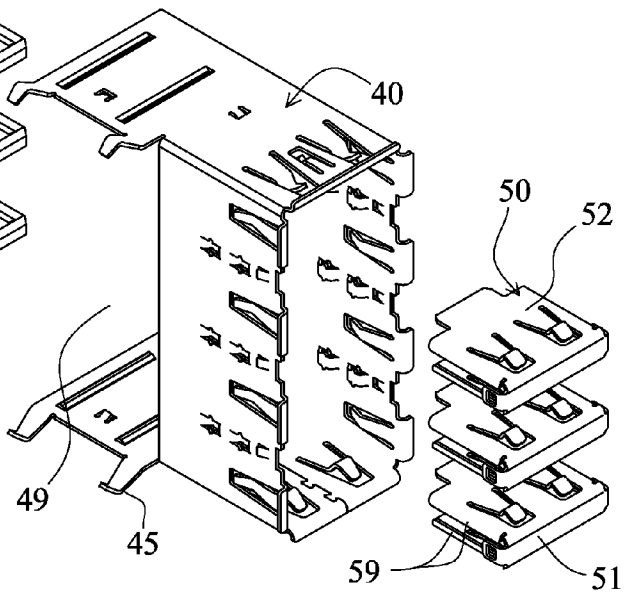
FIG. 14 is a pictorially exploded view showing an insulating seat of a sixth embodiment of the invention.
Figure 14:
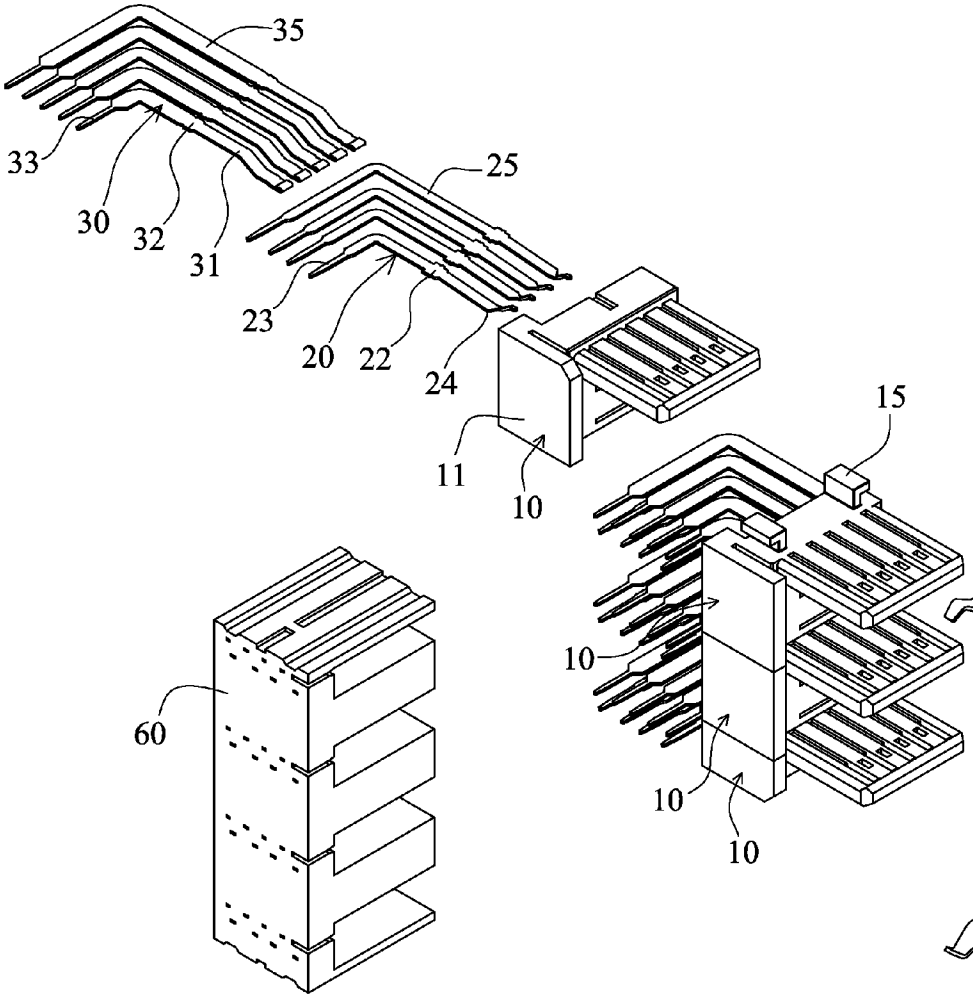
Figure 16:
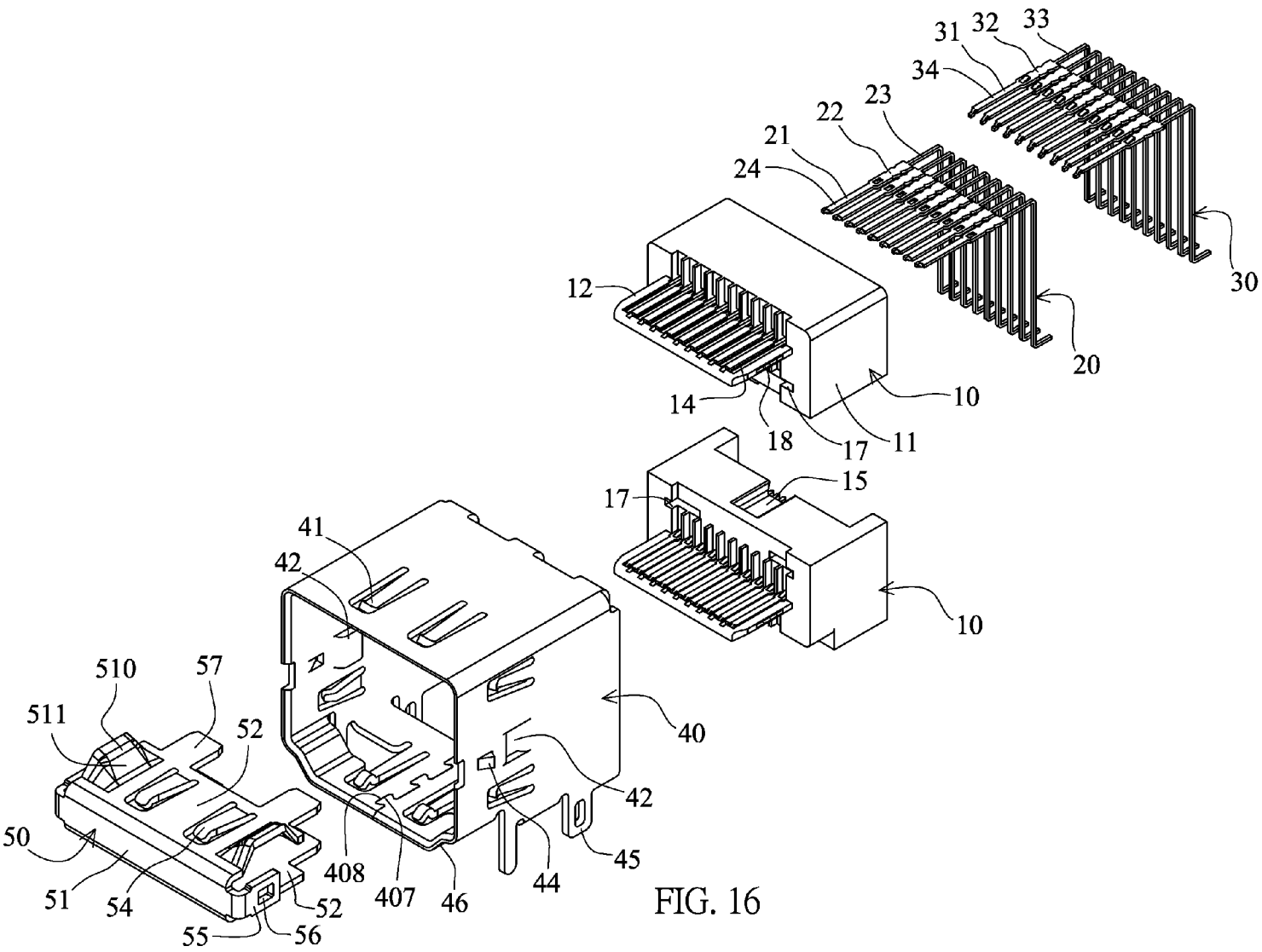
FIG. 16 is a pictorially exploded view of a seventh embodiment of the invention.
Figure 18:
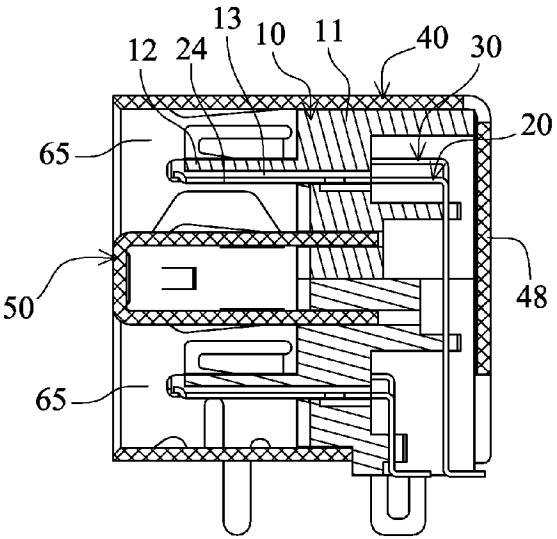
FIG. 18 is a cross-sectional side view showing the seventh embodiment of the invention.

As shown in FIGS. 14 and 15, the sixth embodiment of the invention is a four-layer side vertical USB 3.0 socket and is substantially the same as the second embodiment except for the following differences. The plate surfaces of the extension sections 25, 35 of the pins 23, 33 of the one row of first and second terminals of the four insulating seats 10 are horizontal and are turned by 90 degrees to extend toward one side so that the tail ends of the pins face the side. The side 49 of the rear section of the metal casing 40 is an open end and has four board connecting elements 45 extending toward the side. As shown in FIG. 15, when the electrical connection socket is turned by 90 degrees to enter the lateral standing state and make the tail ends of the pins of the one row of first and second terminals of the four insulating seats 10 and the four board connecting elements 45 be disposed below the metal casing 40, the four insulating seats 10 are transversally stacked, the inserting ports of the four USB 3.0 connection slots 72 face frontwards, and one surface of the tongue 12 of each of the four insulating seats 10 exposing the contact is vertical and extends frontwards.

As shown in FIGS. 16 to 19, the seventh embodiment of the invention is a vertical dual-layer HDMI socket including two insulating seats 10, a metal casing 40 and a separating member 50.

The two insulating seats 10 are formed by way of plastic injection molding. Each insulating seat 10 has a base 11, a tongue 12, one row of nine first terminal slots 13, one row of ten second terminal slots 14 and an engaging structure 15, and is substantially the same as the first embodiment. The top and bottom surfaces of the tongue 12 are jointing surfaces. The engaging structure 15 is disposed on or in the base 11 so that the two insulating seats 10 are stacked vertically. The engaging structure 15 includes the slot engaging with the engaging block. In addition, the front end of the base has a fitting structure 17 in the form of two slots.

Each insulating seat 10 has one row of nine first terminals 20 and one row of ten second terminals 30. The one row of first terminals 20 are assembled and fixed into the one row of first terminal slots 13. The one row of second terminals 30 is assembled and fixed into the one row of second terminal slots 14. The first terminal 20 integrally has an extension 21, a fixing portion 22 and a pin 23. The extension 21 is connected to the front end of the fixing portion 22, extends frontwards and has a contact 24. The extensions 21 of the one row of first terminals are not vertically elastically movable, and the contacts 24 slightly project beyond the bottom surface of the tongue 12. The second terminal 30 integrally has an extension 31, a fixing portion 32 and a pin 33. The extension 31 is connected to the front end of the fixing portion 32, extends frontwards and has a contact 34. The extensions 31 of the one row of second terminals are not vertically elastically movable, and the contact 34 slightly projects beyond the top surface of the tongue 12.

The metal casing 40 has only one housing and covers the two insulating seats 10. The metal casing 40 is the same as that of the first embodiment and has top, bottom, left and right surfaces enclosing a space, and has an opening formed on the other surface. Each of the top and bottom surfaces of the metal casing integrally has two inwardly projecting elastic snaps 41. Each of the left and right surfaces of the metal casing integrally has an elastic inverse snap 44 and an inwardly projecting structure 42, and each of the bottom ends of the metal casing has a board connecting element 45. The bottom of the front section of each of the left and right sides thereof projects inwardly to form an inclined surface 46. In addition, the rear end of the metal casing 40 is integrally bent to form a rear metal cover 48.

The separating member 50 disposed in the metal casing 40 is substantially the same as the first embodiment, wherein the each of the left and right sides of the side plate 52 disposed thereabove is pressed and projects to form a convex portion 510. The convex portion 510 has an inwardly inclined surface 511. The inwardly projecting structure 42 snaps between the two side plates 52 of the separating member 50. The separating member 50 divides the metal casing 40 into two HDMI connection slots 65. Each tongue 12 is disposed in one HDMI connection slot 65. A HDMI plug may be inserted into each HDMI connection slot 65.

Figure 19:
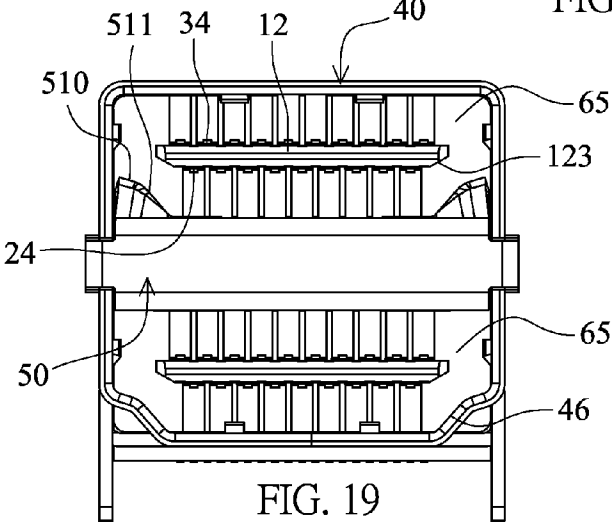
FIG. 19 is a front view of the seventh embodiment of the invention.
Figure 17:
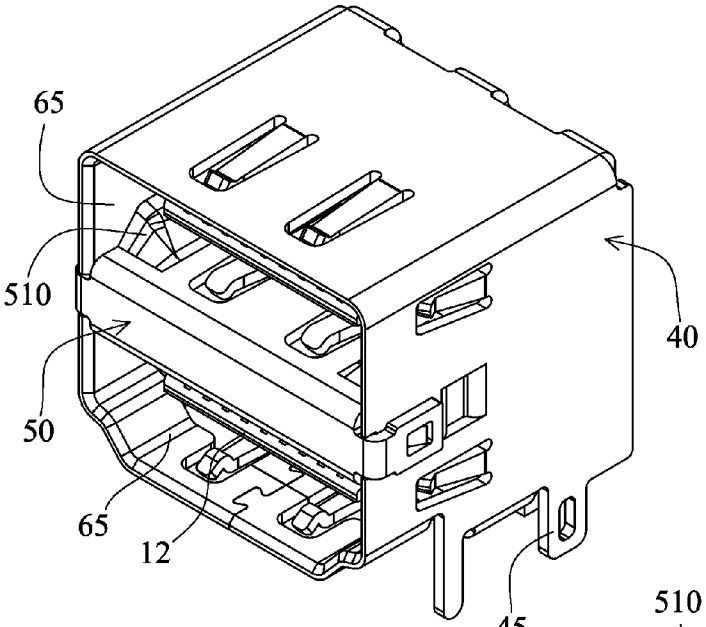
FIG. 17 is a pictorially assembled view showing the seventh embodiment of the invention.
Figure 20:
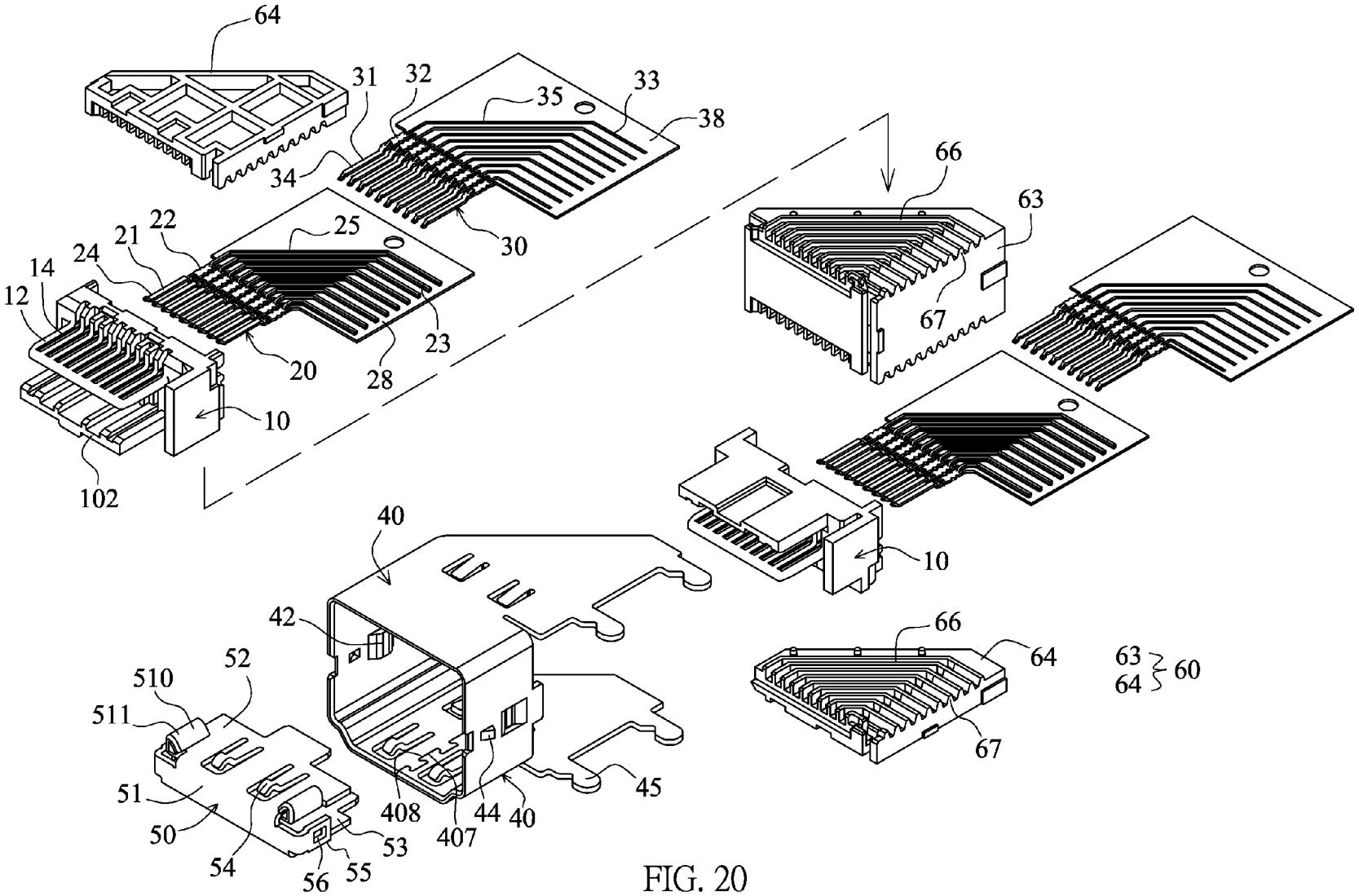
FIG. 20 is a pictorially exploded view of an eighth embodiment of the invention.

As shown in FIG. 19, because each of the left and right sides of the top board 52 of the separating member 50 has a convex portion 510. The inclined surface 511 of the convex portion 510 makes the HDMI connection slot 65 thereabove form front section left and right sides having inclined surfaces to satisfy the connection of the HDMI plug. In addition, two sides of the tongue 12 have inclined surfaces 123 facing one edge formed with the convex portion 510. The one row of contacts 34 and the one row of contacts 24 are arranged in a vertically interlacing manner. When viewed from the insertion direction of the HDMI connection slot 65, the tongue 12 is located at the center of the HDMI connection slot 65.

This embodiment is a HDMI socket. However, the technical features of this invention can be similarly applied to a display port socket.

Figure 23:
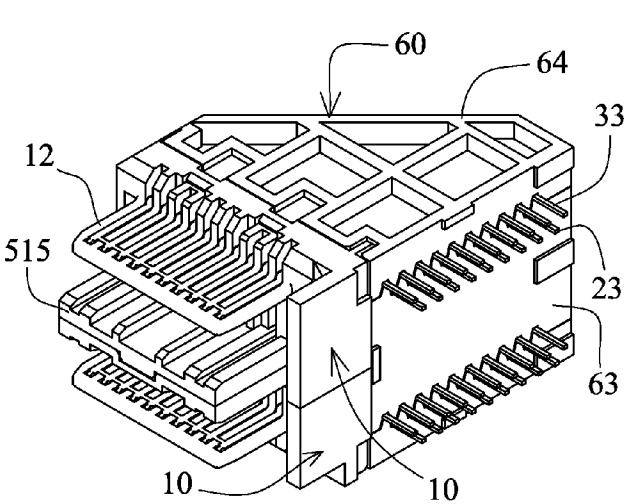
FIG. 23 is a partially pictorially assembled view of the eighth embodiment of the invention.
Figure 24:
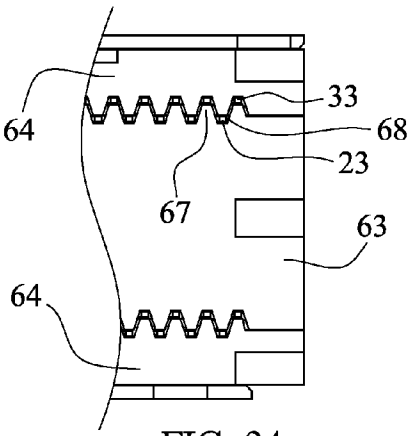
FIG. 24 is a bottom view of the eighth embodiment of the invention.
Figure 21:
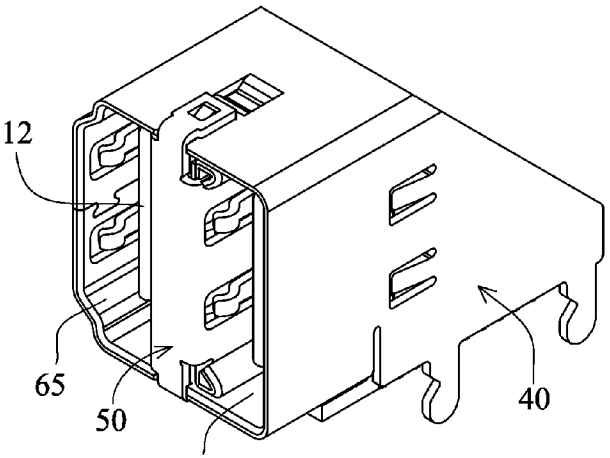
FIG. 21 is a pictorially assembled view of the eighth embodiment of the invention.
Figure 22:
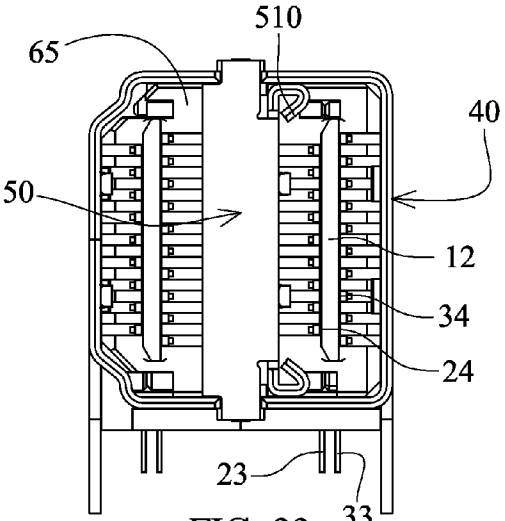
FIG. 22 is a front view of the eighth embodiment of the invention.

As shown in FIGS. 20 to 24, the eighth embodiment of the invention is a dual-layer side vertical HDMI socket and is substantially the same as the sixth and seventh embodiments except for the following differences. Each of two insulating seats 10 integrally has a projecting plate 102 parallel to the tongue 12. As shown in FIG. 23, the two insulating seats 10 are stacked together to form a middle holding plate 515, which can fit between two side plates of the separating member 50. The convex portion 510 of the separating member 50 is formed by reversely bending the plate surface inwardly. In addition, an insulating rear cover 60 formed by stacking two end plates 64 and a middle plate 63 is provided. Each of two corresponding surfaces of the middle plate 63 is formed with one row of positioning slots 66. The positioning slot 66 turns from the front end to the bottom end. The lower section 67 of the baffle of the neighboring positioning slots is tapered. One surface of each of the two end plates 64 stacking with the middle plate 63 is similarly formed with one row of positioning slots 66. The one row of positioning slots 66 of the two corresponding surfaces of the middle plate 63 and the one row of positioning slots 66 of one surface of the stacked two end plates 64 are arranged alternately. The lower sections 67 of the stacked baffles are formed with two rows of positioning holes 68 for positioning the pins 23 of the one row of first terminals 20 and the pins 33 of the one row of second terminals, as shown in FIG. 24. As shown in FIGS. 21 and 22, when the electrical connection socket turns by 90 degrees to enter the lateral standing state, the two insulating seats 10 are transversally stacked, the inserting ports of the two connection slots 65 face frontwards, and the tongues 12 of the two insulating seats 10 are vertical and extend frontwards.

In addition, the one row of first and second terminals 20, 30 are continuous terminals connected to material tapes 28, 38. After the one row of first and second terminals are assembled into the insulating seat 10, the material tapes 28, 38 are broken.

Figure 25:
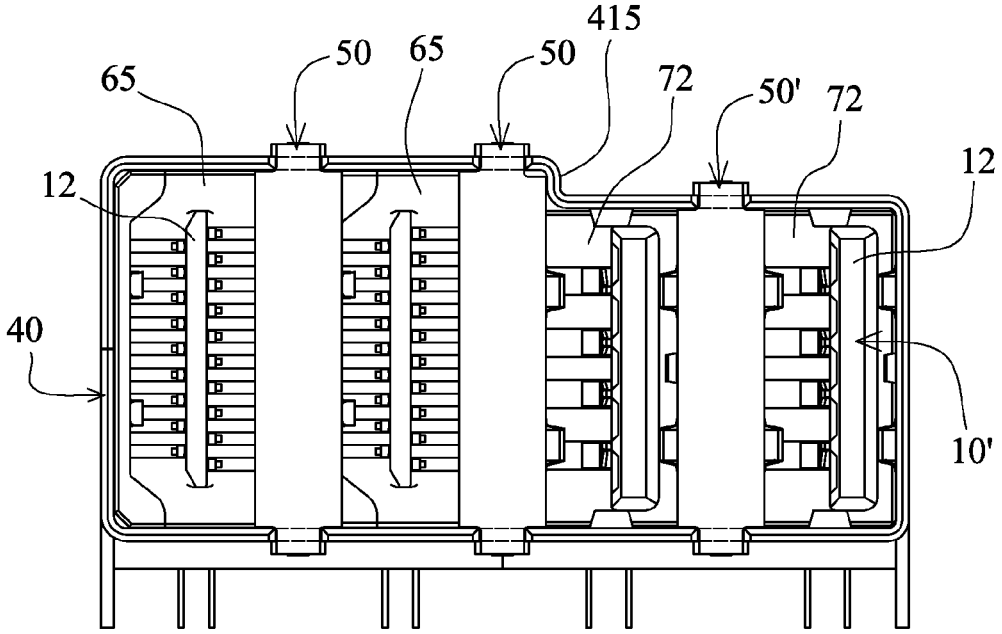
FIG. 25 is a front view of a ninth embodiment of the invention.
Figure 26:
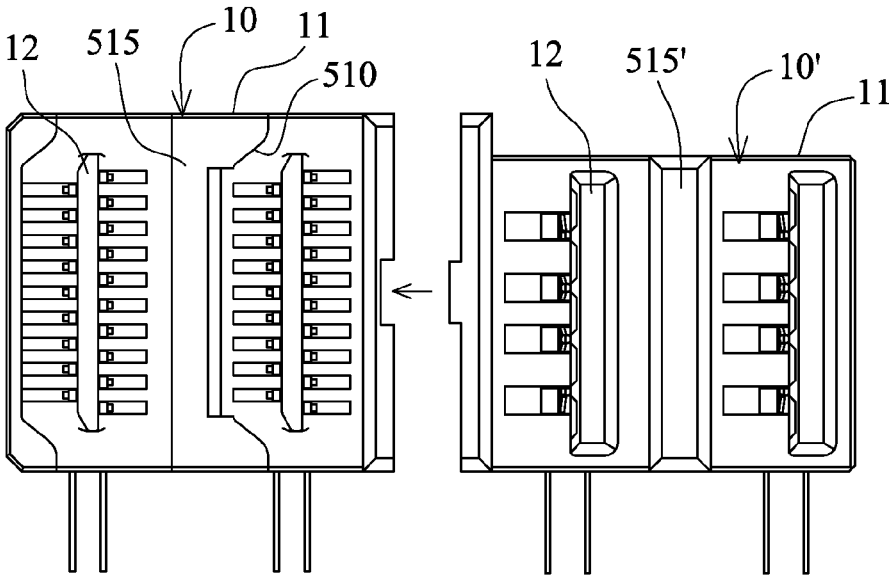
FIG. 26 is an exploded front view showing two insulating seats of the ninth embodiment of the invention.

As shown in FIGS. 25 and 26, the ninth embodiment of the invention is a lateral side standing dual-layer USB 3.0 socket plus the dual-layer HDMI socket and is substantially the same as the sixth and eighth embodiments except for the following differences. In this embodiment, two insulating seats 10, 10' are directly stacked together, and have two separating members 50 and one separating member 50' having different widths. Each of the two insulating seats 10, 10' is formed by way of plastic molding to integrally have a base 11 and two tongues 12. Each of two tongues 12 of the insulating seat 10 has a HDMI contact interface. Each of two tongues 12 of the insulating seat 10' has a USB 3.0 contact interface. The two separating members 50, the one separating member 50' and the metal casing 40 form two HDMI connection slots 65 and two USB 3.0 connection slots 72. Because the HDMI connection slot 65 is wider than the USB 3.0 connection slot 72, one side of the external shape of the metal casing 40 is formed with a step 415. The separating member 50 with the larger width is fit with the middle holding plate 515 of the insulating seat 10. Each of two sides of the middle holding plate 515 is formed with the convex portion 510 to form an inclined surface. The separating member 50' with the smaller width is fit with the middle holding plate 515' of the insulating seat 10'.

With the above-mentioned structure, two HDMI plugs and two USB 3.0 plugs can be concurrently plugged into and connected to the socket of the invention. That is, the sockets with at least two different contact interfaces are concurrently stacked in this invention, so that the convenience in use is achieved.

Figure 27:
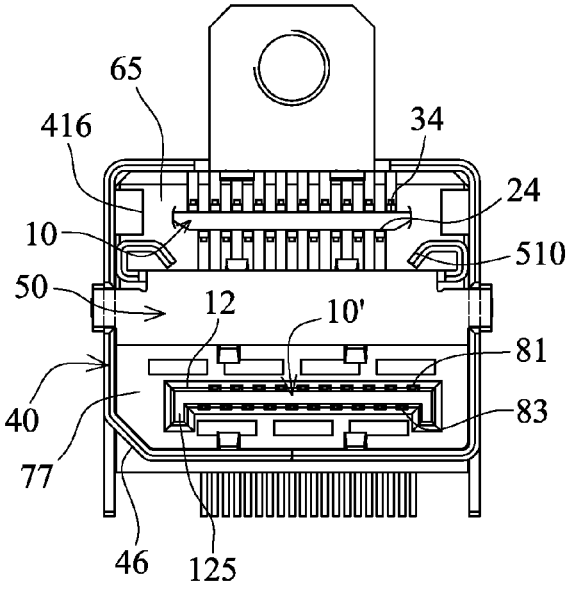
FIG. 27 is a front view of a tenth embodiment of the invention.
Figure 28:
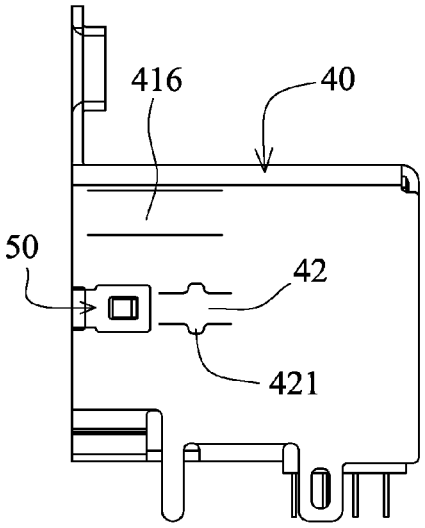
FIG. 28 is a side view showing the tenth embodiment of the invention.

As shown in FIGS. 27 and 28, the tenth embodiment of the invention includes one layer of HDMI socket and one layer of display port socket stacked vertically and is substantially the same as the seventh embodiment except for the following differences. The metal casing 40 and one separating member 50 form a HDMI connection slot 65 and a display port connection slot 77. Each of the top and bottom jointing surfaces of the tongue 12 of the lower insulating seat 10' is formed with contacts 81, 83 of one row of terminals to form a display port contact interface. The display port connection slot 77 can be electrically connected to a display port plug.

In addition, a convex portion 125 perpendicular to the jointing surface is formed on each of two sides of the tongue of the insulating seat 10'. Only one side of the metal casing 40 is formed with an inclined surface 46, and each of two side surfaces of the metal casing 40 is prodded and pressed to form a projecting convex portion 416 toward the connection slot 65 so that the inner width of the HDMI connection slot 65 is reduced.

In addition, similar to the second embodiment, two sides of the two side plates of the separating member 50 are formed with vertical bent portions resting against and snapping to the inwardly projecting structure 42 of the metal casing 40 in the vertical direction, and hooking and restricting the hook portion 421 in the left-to-right direction.

Figure 29:
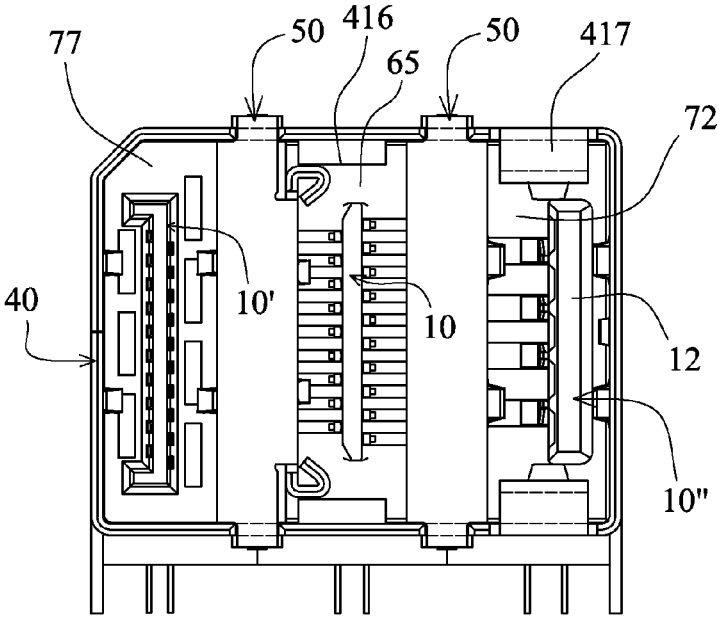
FIG. 29 is a front view of an eleventh embodiment of the invention.

As shown in FIG. 29, the eleventh embodiment of the invention is a lateral side standing single-layer USB 3.0 socket plus a single-layer HDMI socket plus a single-layer display port socket, and is substantially the same as the sixth and tenth embodiments except for the following differences. The three insulating seats 10", 10, 10' are directly stacked together. The metal casing 40 and the two separating members 50 form a USB 3.0 connection slot 72, a HDMI connection slot 65 and a display port connection slot 77. Each of front ends of two sides of the metal casing 40 is reversely bent toward the inside of the USB 3.0 connection slot 72 to form a convex portion 417, so that the inner width of the USB 3.0 connection slot 72 is decreased and the width of the display port connection slot 77 is larger than the width of the HDMI connection slot 65, which is larger than the width of the USB 3.0 connection slot 72.

Figure 30:
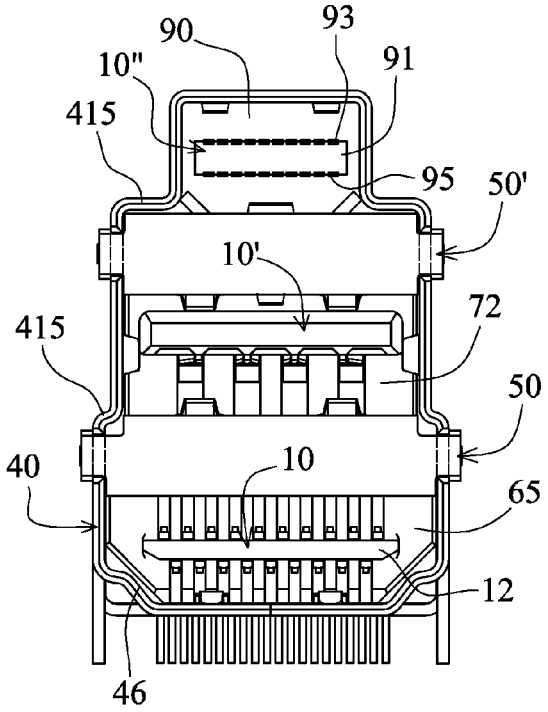
FIG. 30 is a front view of a twelfth embodiment of the invention.

As shown in FIG. 30, the twelfth embodiment of the invention includes a single-layer Thunderbolt (Mini DisplayPort) socket, a single-layer USB 3.0 socket and a single-layer HDMI socket stacked together vertically, and is substantially the same as the ninth and tenth embodiments except for the following differences. The three insulating seats 10", 10', 10 are directly stacked vertically. The metal casing 40 and the two separating members 50', 50 form a Thunderbolt connection slot 90, a USB 3.0 connection slot 72 and a HDMI connection slot 65. The insulating seat 10" has a tongue 91. The tongue 91 is disposed in the Thunderbolt connection slot 90 and has the top and bottom jointing surfaces, on which the contacts 93, 95 of one row of terminals form the Thunderbolt contact interface. The contacts 93, 95 are aligned vertically. A Thunderbolt plug may be electrically connected to the Thunderbolt connection slot 90.

Figure 31:
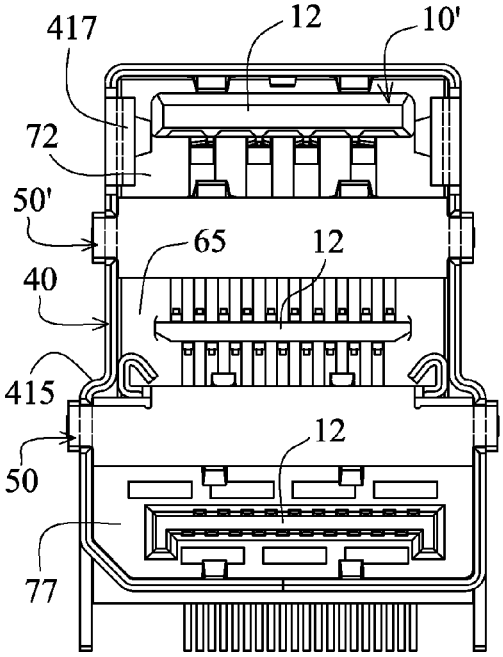
FIG. 31 is a front view of a thirteenth embodiment of the invention.
Figure 32:
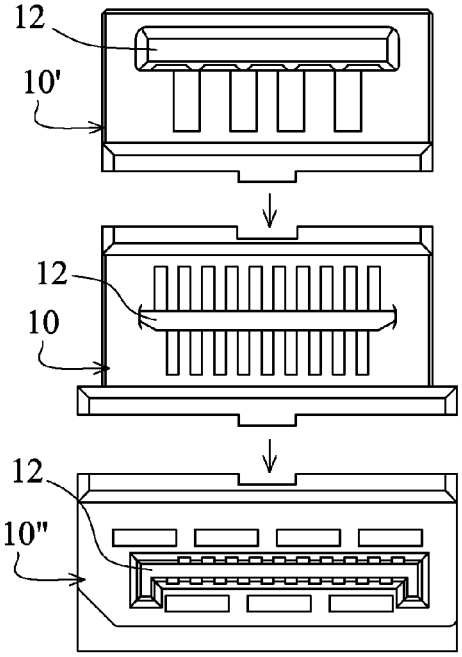
FIG. 32 is an exploded front view showing three insulating seats of the thirteenth embodiment of the invention.

As shown in FIGS. 31 and 32, the thirteenth embodiment of the invention includes a single-layer USB 3.0 socket, a single-layer HDMI socket and a single-layer DisplayPort socket stacked vertically, and is substantially the same as the eleventh and twelfth embodiments except for the following differences. The metal casing 40 and the two separating members 50, 50' form a USB 3.0 connection slot 72, a HDMI connection slot 65 and a DisplayPort connection slot 77. In addition, two sides of the metal casing 40 are formed with steps 415 and convex portions 417.

Figure 33:
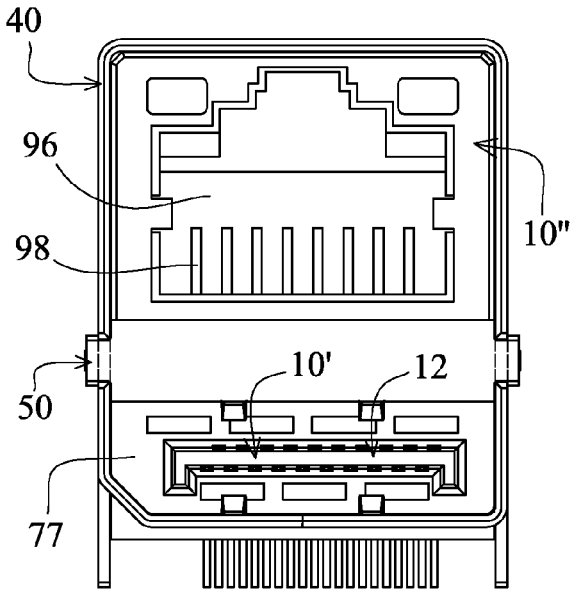
FIG. 33 is a front view of a $14^{th}$ embodiment of the invention.

As shown in FIG. 33, the $14^{th}$ embodiment of the invention includes a single-layer RJ45 socket and a single-layer DisplayPort socket stacked vertically, and is substantially the same as the tenth embodiment. The two insulating seats 10", 10' are directly stacked vertically. The difference resides in that the insulating seat 10" integrally has an RJ45 connection slot 96. Elastically movable contacts 98 of one row of terminals are disposed in the RJ45 connection slot 96 to form the RJ45 contact interface. An RJ45 plug can be electrically connected to the RJ45 connection slot 96.

Figure 34:
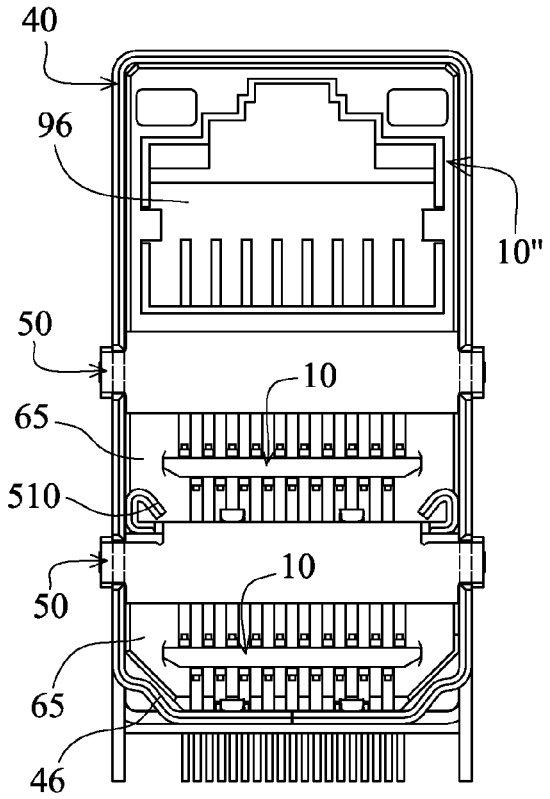
FIG. 34 is a front view of a $15^{th}$ embodiment of the invention.
Figures 35, 36:
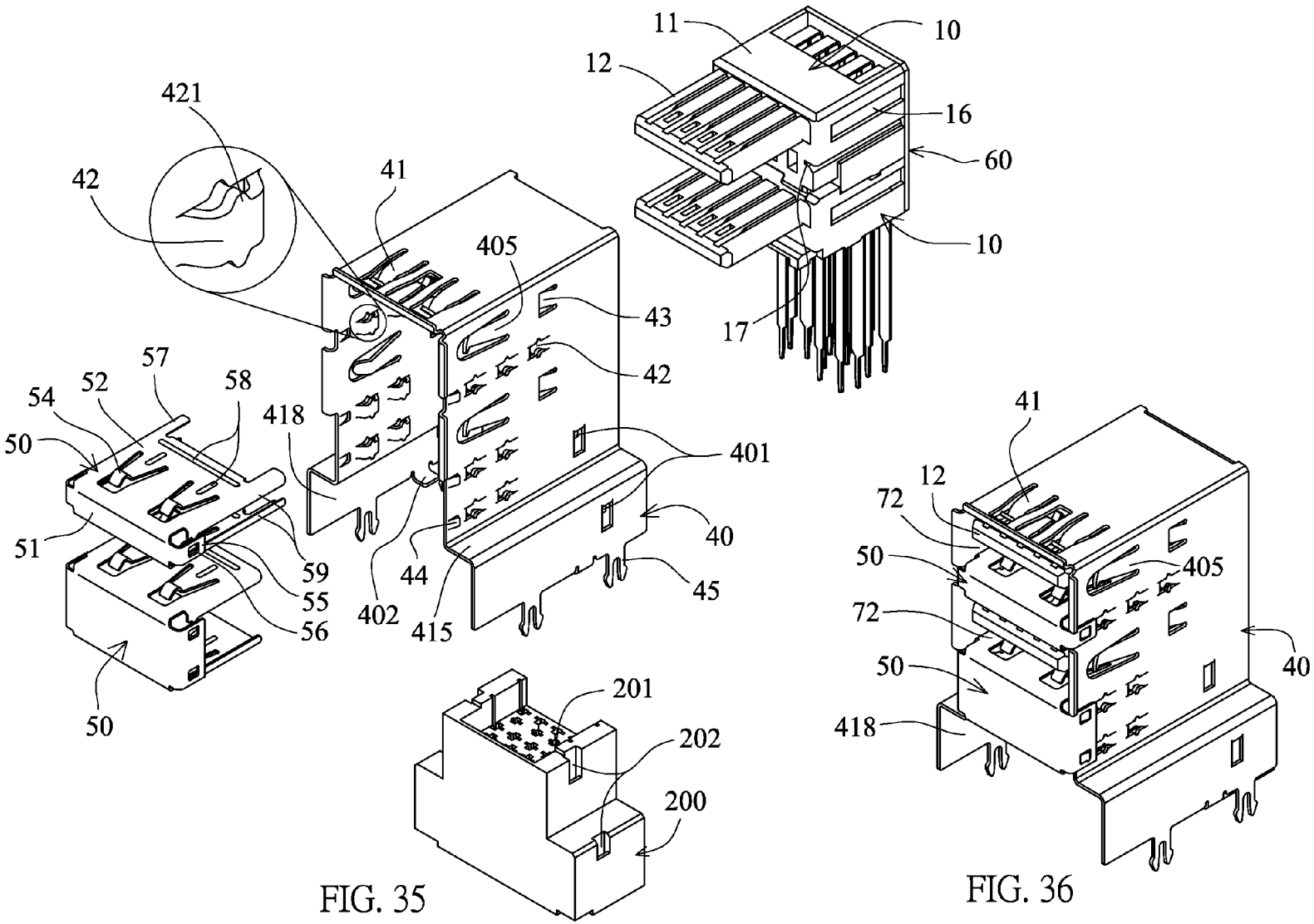
FIG. 35 is a pictorially exploded view of a $16^{th}$ embodiment of the invention.
FIG. 36 is a pictorially assembled view of the $16^{th}$ embodiment of the invention.
Figure 38:
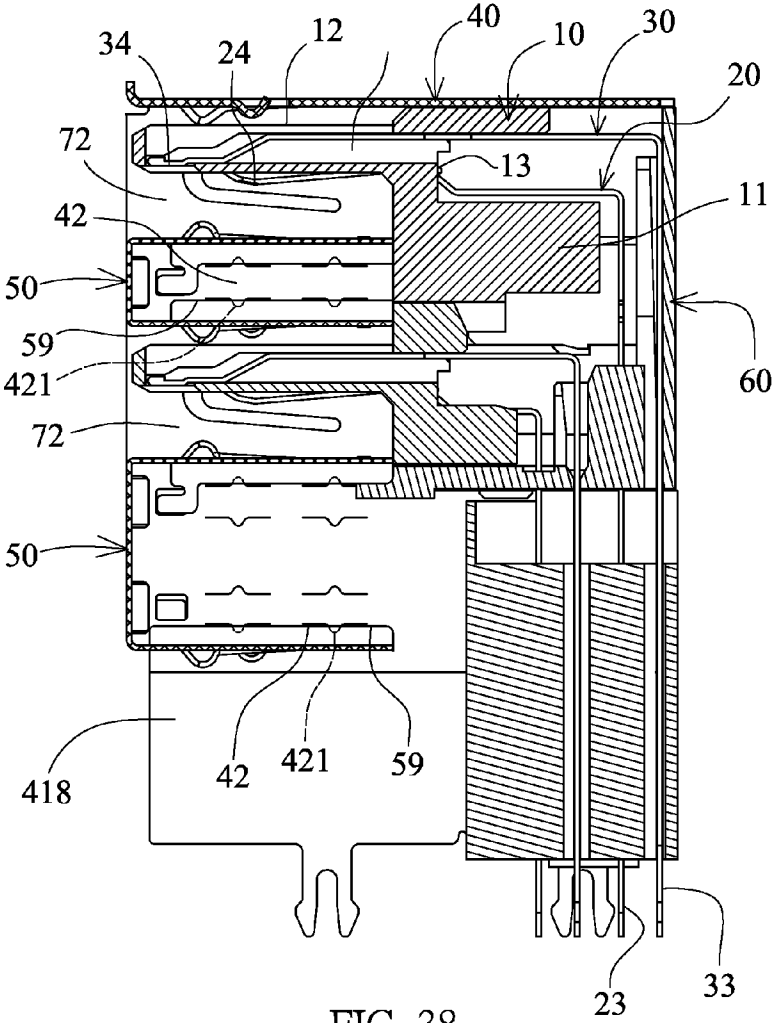
FIG. 38 is a cross-sectional side view of the $16^{th}$ embodiment of the invention.

As shown in FIG. 34, the $15^{th}$ embodiment of the invention includes a single-layer RJ45 socket and a dual-layer HDMI socket stacked vertically, and is substantially the same as the seventh and fourteenth embodiments.

As shown in FIGS. 35 to 39, the $16^{th}$ embodiment of the invention is a dual-layer USB 3.0 raised socket with the vertical stacking structure, includes two insulating seats 10, an insulating rear cover 60, a metal casing 40, a raised seat 200 and two separating members 50, and is substantially the same as the second embodiment except for the difference that the engaging block 151 and the slot 152 of the engaging structure 15 of the two insulating seats 10 have dovetailed shapes and engage with each other in the top, bottom, left and right portions.

The metal casing 40 covers the two insulating seats 10. The metal casing 40 is a metal plate integrally bent into left, right and top surfaces, wherein the front end, the rear end and the bottom end of the metal casing are open and the metal casing is a raised housing. Each of the left and right surfaces of the metal casing is formed with a step 415, so that the internal bottommost section is formed with a wider accommodating space 418. Each of the left and right surfaces of the metal casing is formed with two inwardly projecting engaging blocks 401. Each of the bottom ends of the left and right surfaces of the metal casing is formed with two board connecting elements 45 and is bent inwards to form a horizontal engaging plate 402.

The raised seat 200 has a "T" shape and is formed with four rows of through holes arranged in the vertical direction 201, and has two sides each formed with two slots 202. The raised seat 200 is disposed below and assembled into the two insulating seats 10 to raise the two insulating seats 10. The pins 23, 33 of the one row of first and second terminals of the two insulating seats 10 pass through the insulating rear cover 60 and the raised seat 200 to achieve the positioning effect. The two side slots 202 engage with the engaging blocks 401 of the metal casing 40. The engaging plate 402 of the metal casing 40 engages with the bottom surface of the raised seat 200. In addition, the insulating rear cover 60 and the raised seat 200 may also be integrally injection molded.

The two separating members 50 have different heights. The two separating members 50 divide the top section of the metal casing 40 into two USB 3.0 connection slots 72. The higher separating member 50 is provided to separate the lower USB 3.0 connection slot 72 from the accommodating space 418 by a height.

Figure 37:
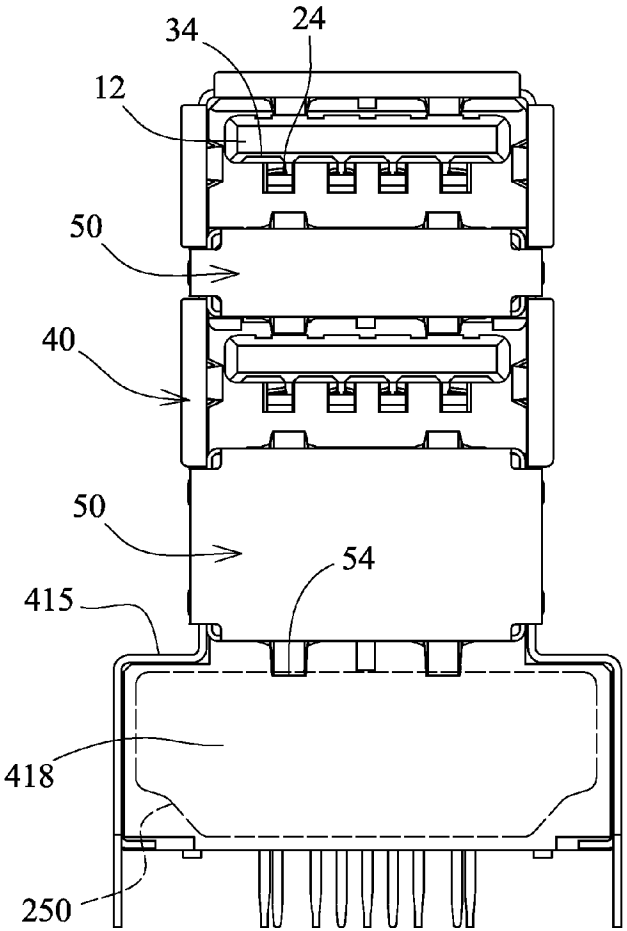
FIG. 37 is a front view of the $16^{th}$ embodiment of the invention.
Figure 39:
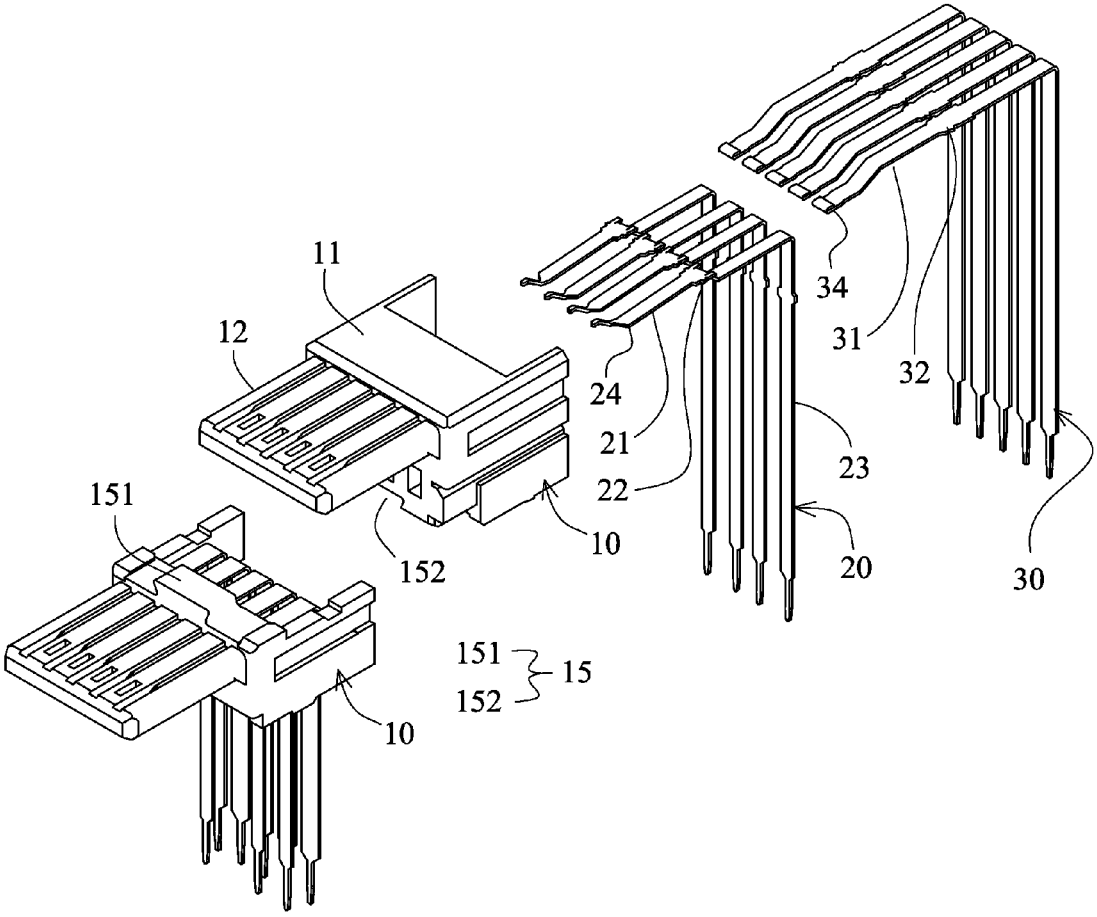
FIG. 39 is a partially pictorially exploded view of the $16^{th}$ embodiment of the invention.
Figure 39:
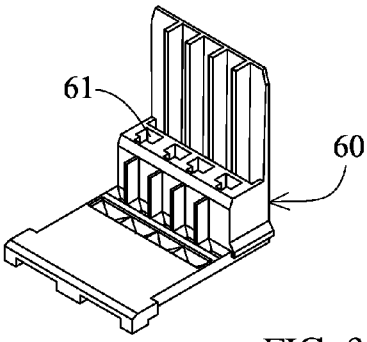

With the above-mentioned structure, the metal casing 40 is directly formed with a wider accommodating space 418 below the two USB 3.0 connection slots 72, as shown in FIG. 37. The accommodating space 418 can accommodate a HDMI socket 250 or a DisplayPort socket. The elastic snap 54 of the lower separating member 50 elastically rests against the HDMI connector 250 to form the grounding effect, so that the better space arrangement in use can be achieved. The metal casing 40 is directly formed with two USB 3.0 connection slots 72 and covers the two tongues 12 in conjunction with the two separating members 50 so that the convenience in manufacturing can be achieved. In addition, the bent portions 59 of the two separating members 50 vertically rest against the inwardly projecting structure 42 and hook and restrict the hook portion 421 in the left-to-right direction, so that the metal casing 40 can be combined firmly, and it is possible to prevent the left and right surfaces of the metal casing 40 from expanding by the external force. Although the rear end of the metal casing 40 is not covered with a rear metal cover, the good structure strength is still obtained.

Figure 40:
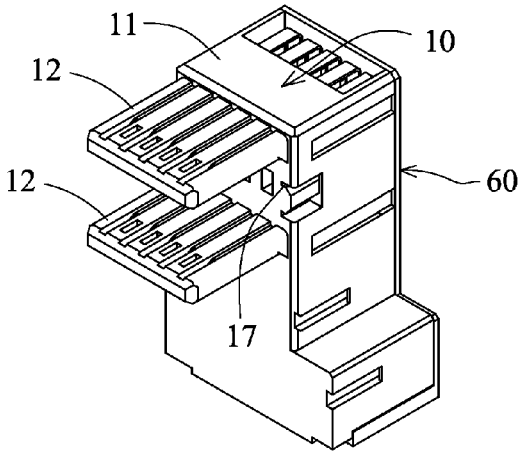
FIG. 40 is a pictorial view of a $17^{th}$ embodiment of the invention.

As shown in FIG. 40, the $17^{th}$ embodiment of the invention is substantially the same as the $16^{th}$ embodiment except for the difference that an insulating seat 10 is integrally provided and a raised base is provided.

Figures 41, 42:
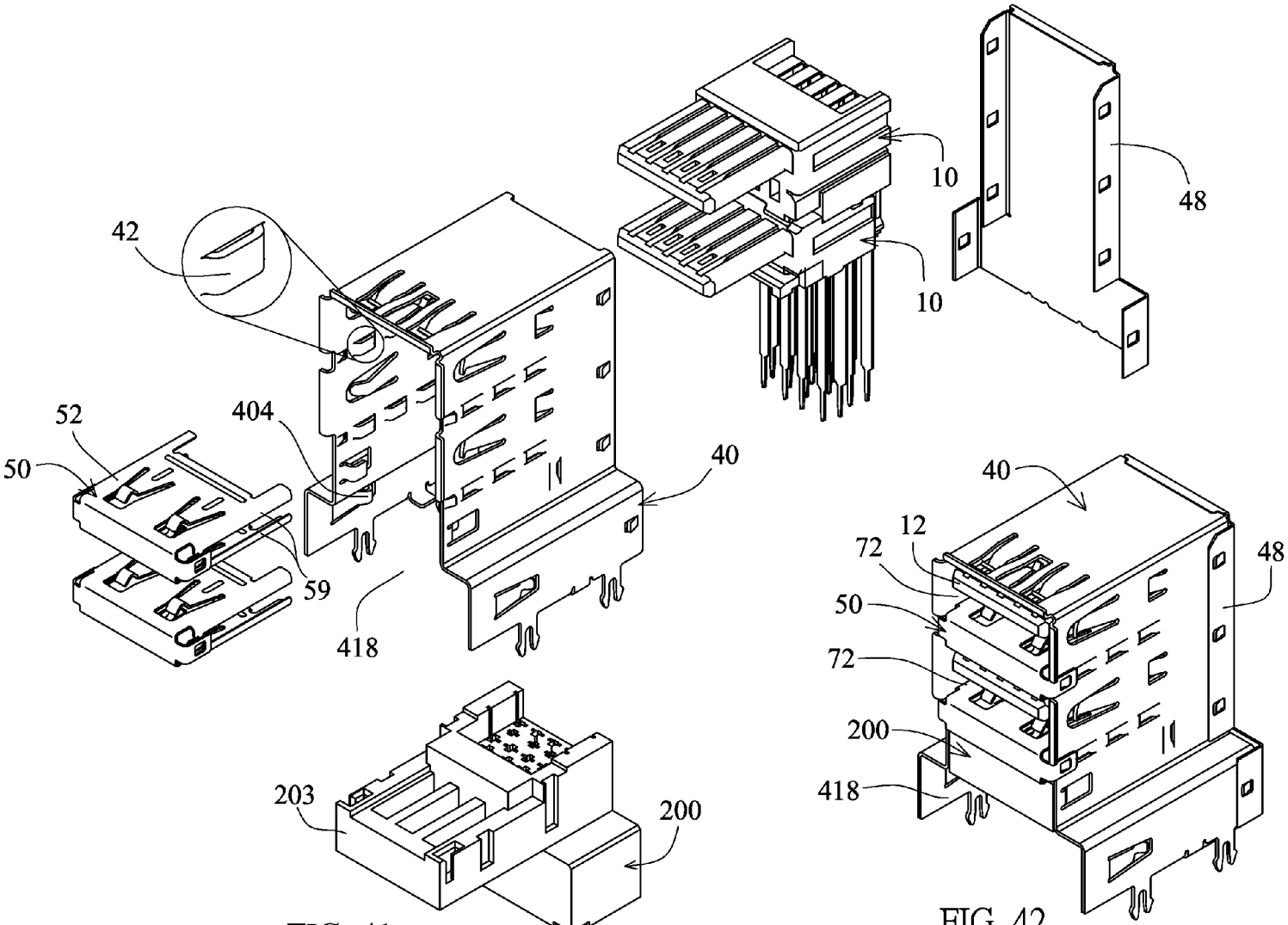
FIG. 41 is a pictorially exploded view of an $18^{th}$ embodiment of the invention.
FIG. 42 is a pictorially assembled view showing the $18^{th}$ embodiment of the invention.

As shown in FIGS. 41 and 42, the $18^{th}$ embodiment of the invention is substantially the same as the $16^{th}$ embodiment except for the following differences. The two separating members 50 have the same height. In this embodiment, the front end of the raised seat 200 is formed with a projection 203 to fill the space. The inwardly projecting structure 42 of the metal casing 40 is not formed with a hook portion. Each of two sides of the metal casing 40 is formed with an elastic sheet 404 projecting toward the accommodating space 418, and the rear end of the metal casing is covered with a rear metal cover 48.

In addition, the raised socket may also adopt stacked tongues fitting with the plastic frame.

Figures 43, 44, 45:
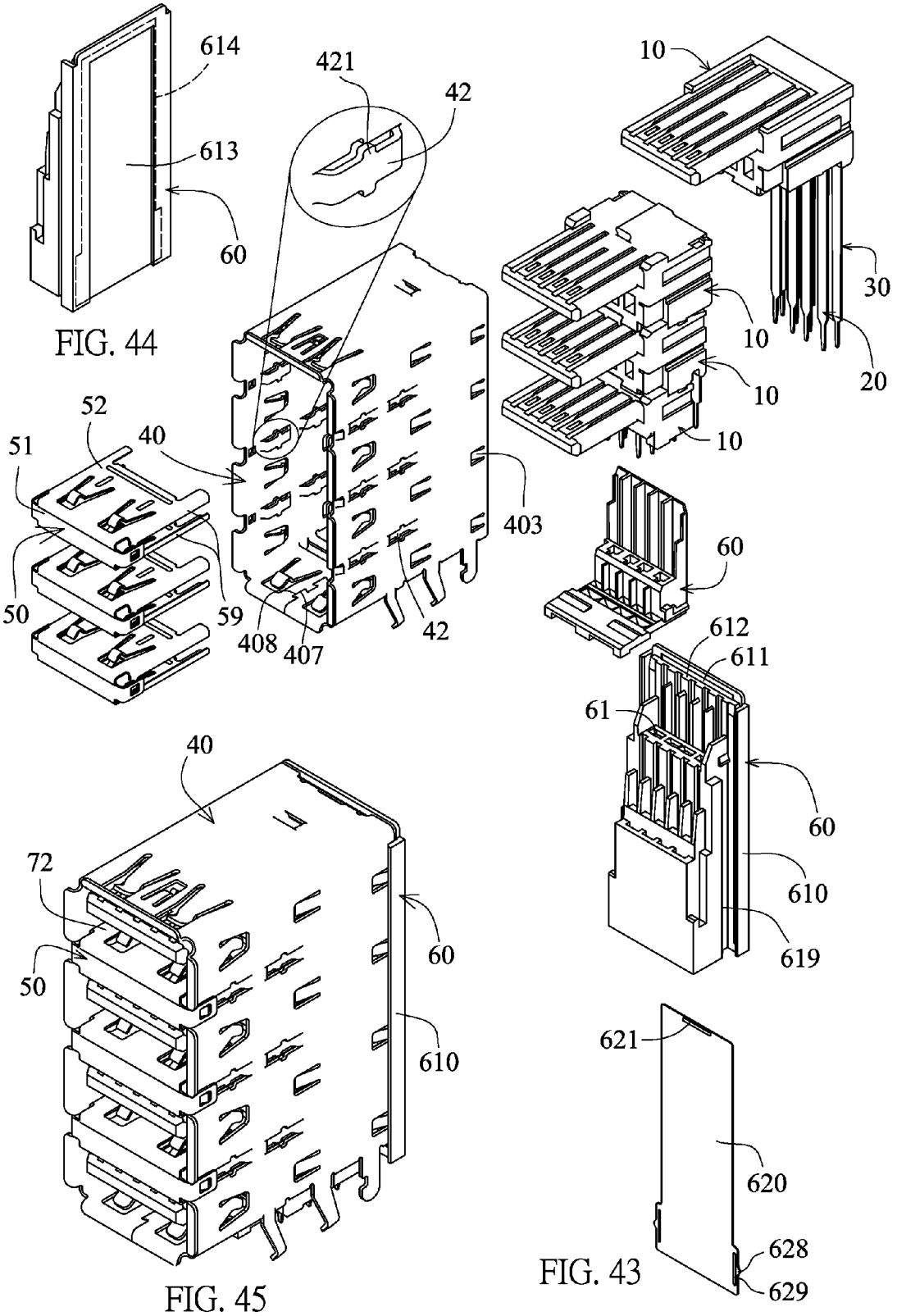
FIG. 43 is a pictorially exploded view of a $19^{th}$ embodiment of the invention.
FIG. 44 is a pictorial view showing an insulating rear cover of the $19^{th}$ embodiment of the invention.
FIG. 45 is a pictorially assembled view of the $19^{th}$ embodiment of the invention.

As shown in FIGS. 43 to 45, the $19^{th}$ embodiment of the invention is substantially the same as the second embodiment except for the following differences. The rear end of the metal casing 40 is not covered with a rear metal cover. However, the rear insulating rear cover 60 has a vertically extending metal sheet 620. The top end of the metal sheet 620 is formed with a frontward projecting hook 621, and each of left and right sides of the lower section thereof is formed with a convex portion 628 and a through hole 629. The through hole 629 allows the convex portion 628 to move in the left-right direction. Each of the rear ends of the left and right sides of the metal casing 40 is formed with one row of vertically arranged elastic inverse hooks 403. The insulating rear cover 60 has a backside and multiple through holes 61. The through holes 61 are parallel to the backside, and the pins of the terminals pass through the through holes 61. Each of the left and right side surfaces of the insulating rear cover 60 is formed with a vertically extending engaging slot 619, and the backside of the insulating rear cover is formed with a concave surface 613. The left and right sides of the concave surface 613 are formed with slots 614. The bottom end of the concave surface 613 is the entrance. A slot 611 and a stopping surface 612 lower than the slot 611 are disposed above the front side of the rear end of the insulating rear cover 60. The metal sheet 620 is placed into the concave surface 613 from bottom to top. Two sides of the metal sheet 620 are engaged by the slots 614. The top end of the metal sheet 620 engages with the slot 611 and the hook 621 hooks the stopping surface 612. The two convex portions 628 can elastically rest against the metal casing 40 to make the metal sheet be grounded. The engaging slot 619 of the insulating rear cover 60 is engaged with the elastic inverse hook 403 of the metal casing 40. In addition, each of the backside left and right sides of the insulating rear cover 60 is formed with an engaging plate 610 extending in a frontward direction perpendicular thereto. The engaging plate 610 extends from the bottom end of the insulating rear cover 60 to the top end thereof. The two engaging plates 610 engage with and restrict the left and right sides of the rear end of the metal casing 40. In addition, the engaging plate 610 may also be disposed in a small section or small sections.

In this embodiment, the engaging elements for hooking the metal casing on the left and right sides are the three separating members 50 and the insulating rear cover 60 to achieve the firm structure strength. The elastic inverse hook 403 engages with the engaging slot 619 to prevent the insulating rear cover 60 from ejecting. The insulating rear cover 60 is directly fit with a metal sheet 620 in a very simple manner to achieve the metal shielding effect without a rear metal cover being assembled.

In addition, the metal casing 40 of this embodiment may also be correspondingly designed as a raised housing so that an accommodating space is formed therebelow. Each of the left and right sides of the insulating rear cover may be formed with a vertically extending slot. The left and right sides of the metal casing are formed with vertically arranged inwardly projecting structures. The hook portion 421 of the inwardly projecting structure hooks and restricts the slot of the insulating rear cover in the left-to-right direction. The metal sheet 620 may also be assembled and engaged with the backside of the insulating rear cover in the left-to-right direction by way of, for example, hot melting fixing or adhesive fixing.

Furthermore, the structure of this embodiment may also be applied to the stacked vertically HDMI socket or the socket with different interfaces stacked vertically.

Figure 46:
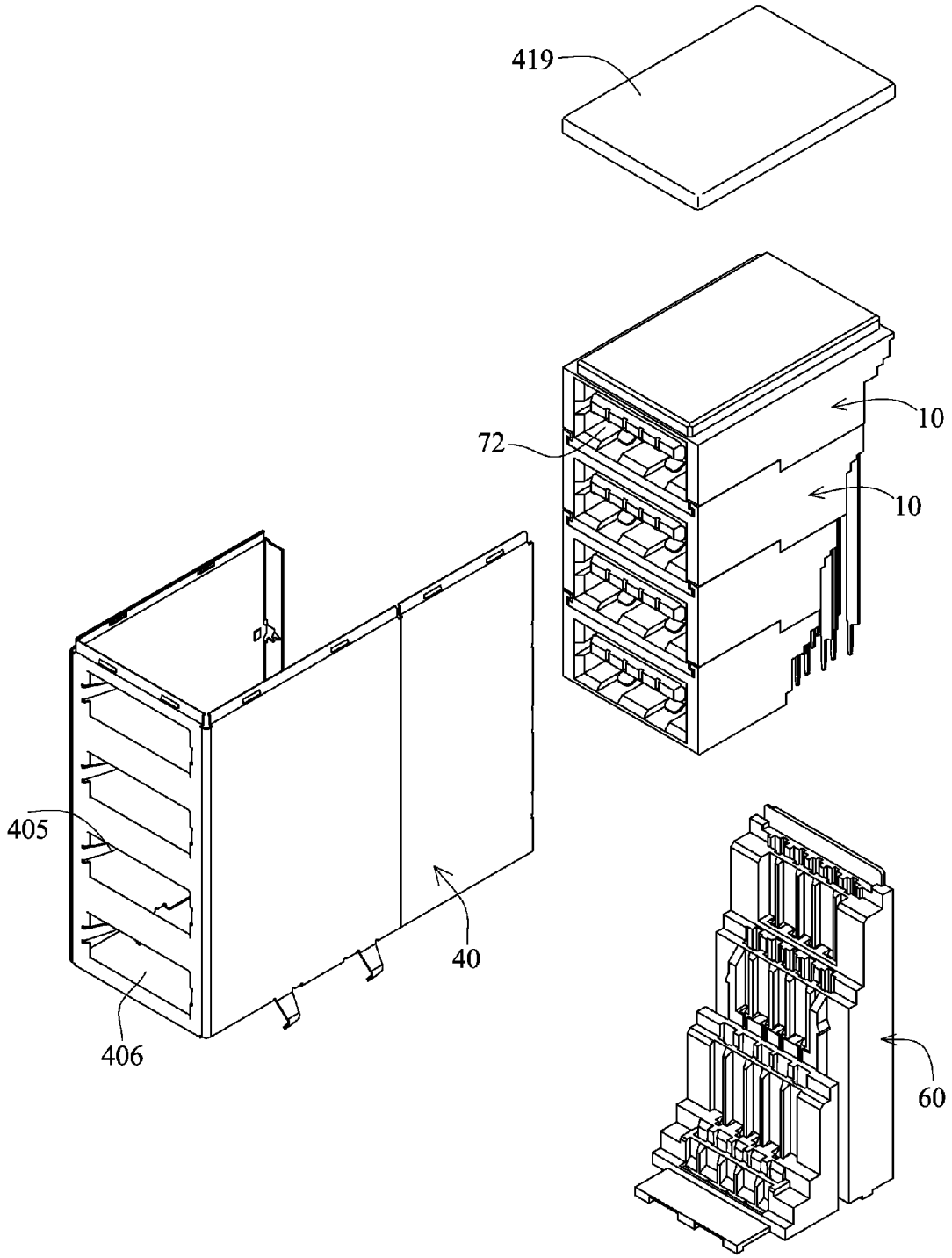
FIG. 46 is a pictorially exploded view of a $20^{th}$ embodiment of the invention.
Figure 48:
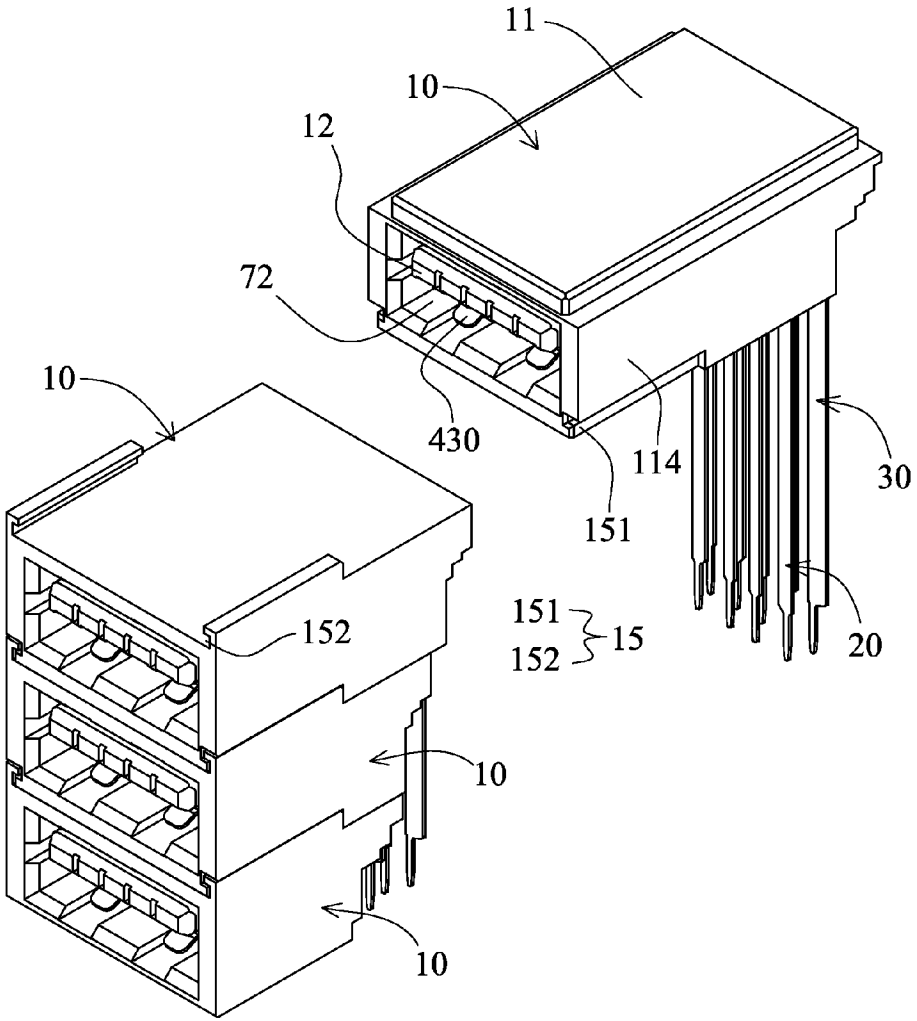
FIG. 48 is a partially pictorially exploded view showing the $20^{th}$ embodiment of the invention.
Figure 47:
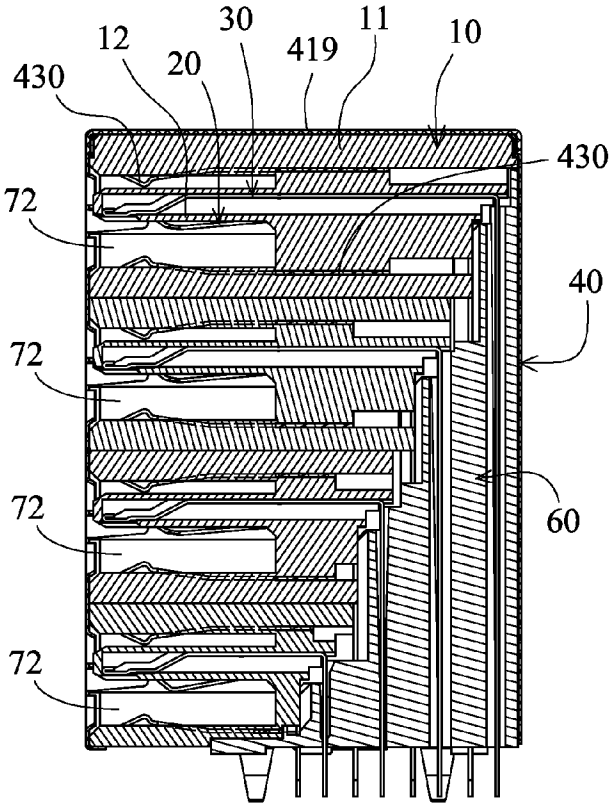
FIG. 47 is a cross-sectional side view of the $20^{th}$ embodiment of the invention.

As shown in FIGS. 46 to 48, the 20$^{th}$ embodiment of the invention is substantially the same as the first and third embodiments except for the following differences. The bases 11 of the four insulating seats 10 integrally have a frontward four-side frame 114 covering the tongue 12. A USB 3.0 connection slot 72 is formed in the frame 114. Each insulating seat 10 is assembled with four elastic snaps 430. Each of the top and bottom surfaces of the USB 3.0 connection slot 72 is projected to form two elastic snaps 430. The engaging structure 15 has engaging blocks 151 on two sides of the bottom surface of the frame 114 of the front section of the upper base 11, and slots 152 on two sides of the top surface of the frame 114 of the front section of the lower base 11. The bases 11 of the four insulating seats 10 can be assembled together in the front-rear direction and are stacked vertically for positioning, and can lock with each other in the top-bottom and left-right directions.

Figure 49:
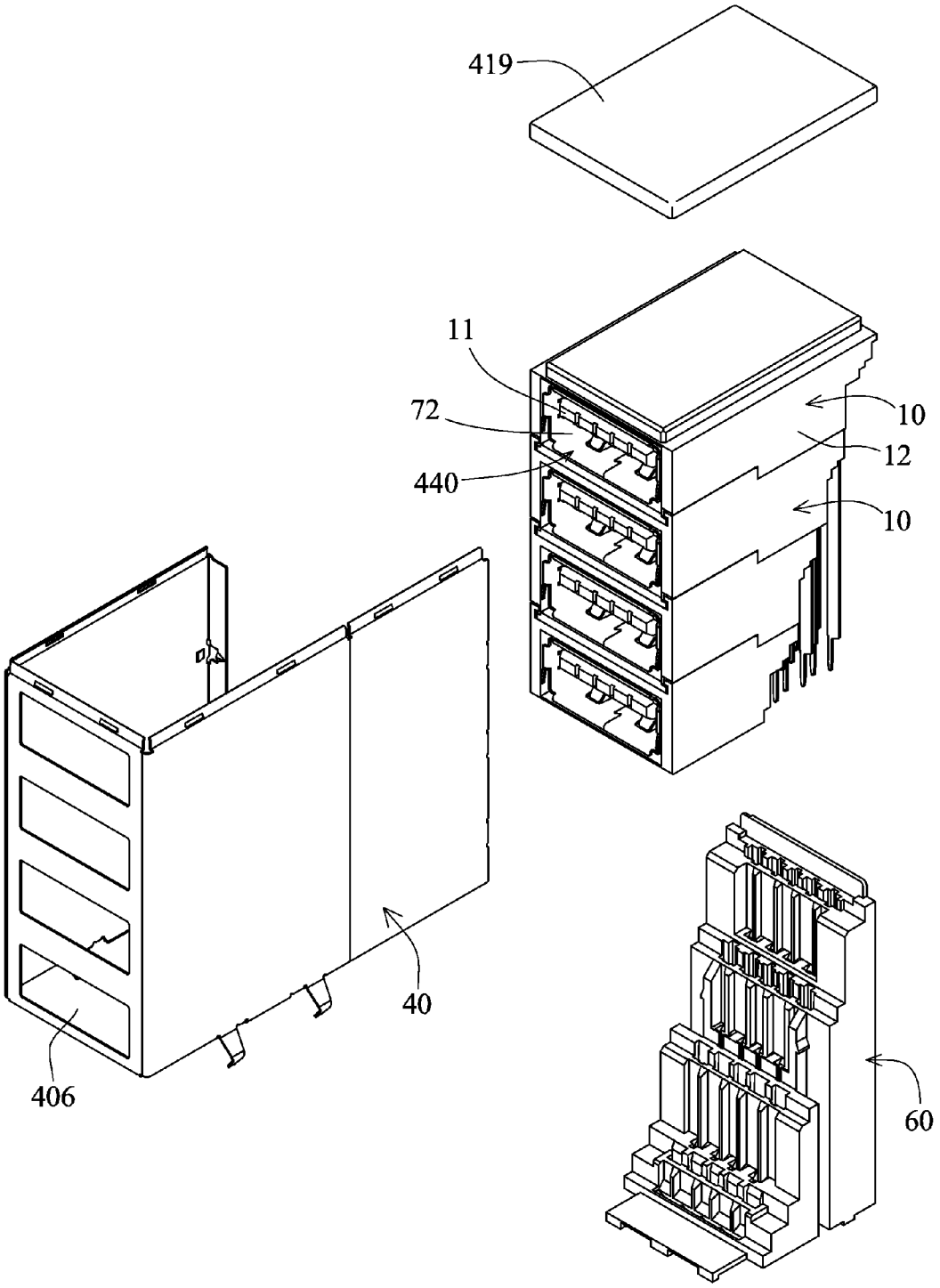
FIG. 49 is a pictorially exploded view of a $21^{st}$ embodiment of the invention.
Figure 51:
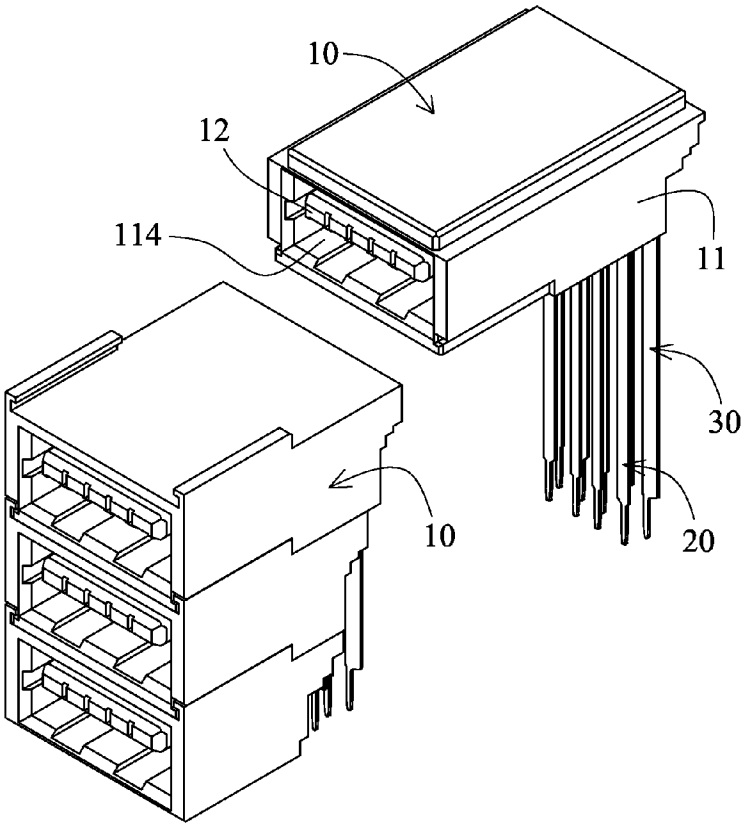
FIG. 51 is a partially pictorially exploded view of the $21^{st}$ embodiment of the invention.
Figure 50:
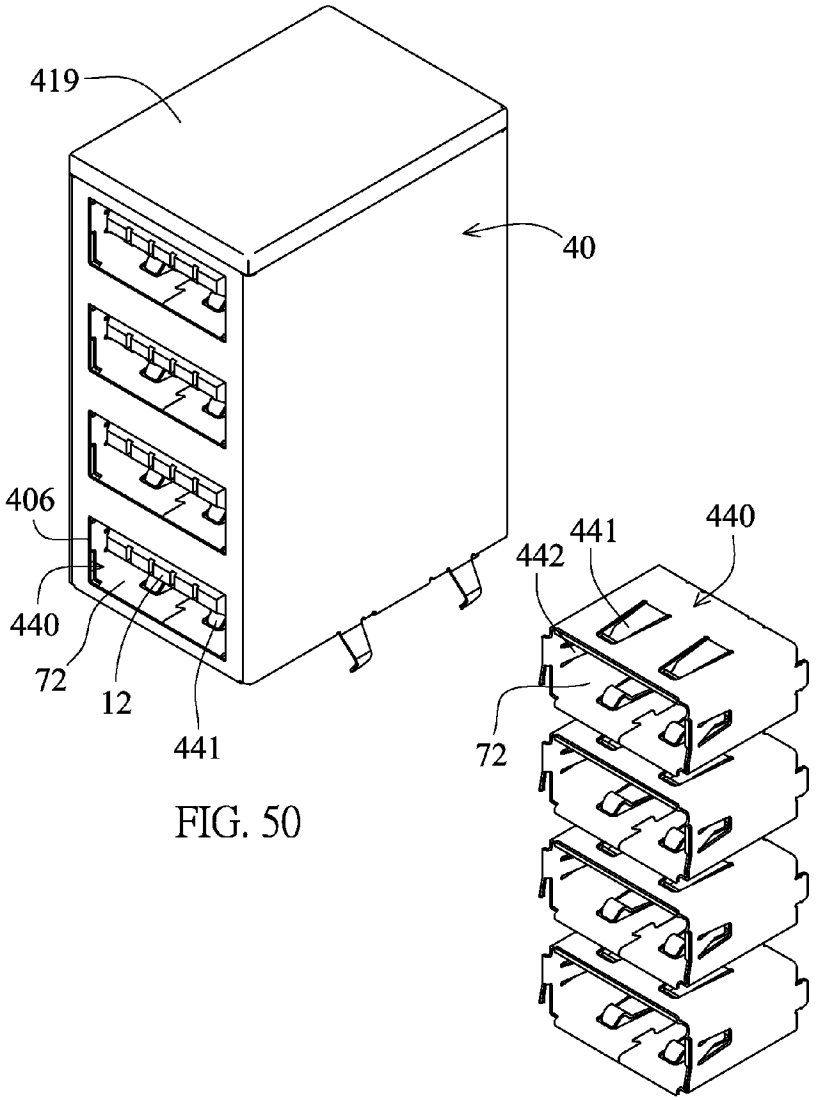
FIG. 50 is a pictorially assembled view of the $21^{st}$ embodiment of the invention.

As shown in FIGS. 49 to 51, the 21$^{st}$ embodiment of the invention is substantially the same as the 20$^{th}$ embodiment except for the following differences. A metallic separating member 440 is assembled into the frame 114 of the base 11 of each insulating seat 10. The separating member 440 is a metal casing and has four surfaces covering the tongue 12. A USB 3.0 connection slot 72 is formed in the separating member 440. Each of the top and bottom surfaces of the separating member 440 integrally has two elastic snaps 441 projecting toward the USB 3.0 connection slot 72. Each of two side surfaces of the separating member 440 integrally has a grounding elastic contact sheet 442 projecting toward the USB 3.0 connection slot 72. Thus, the top, bottom, left and right surfaces of the USB 3.0 connection slot 72 are metal surfaces and can also achieve the good metal surface shielding effect.

Figure 52:
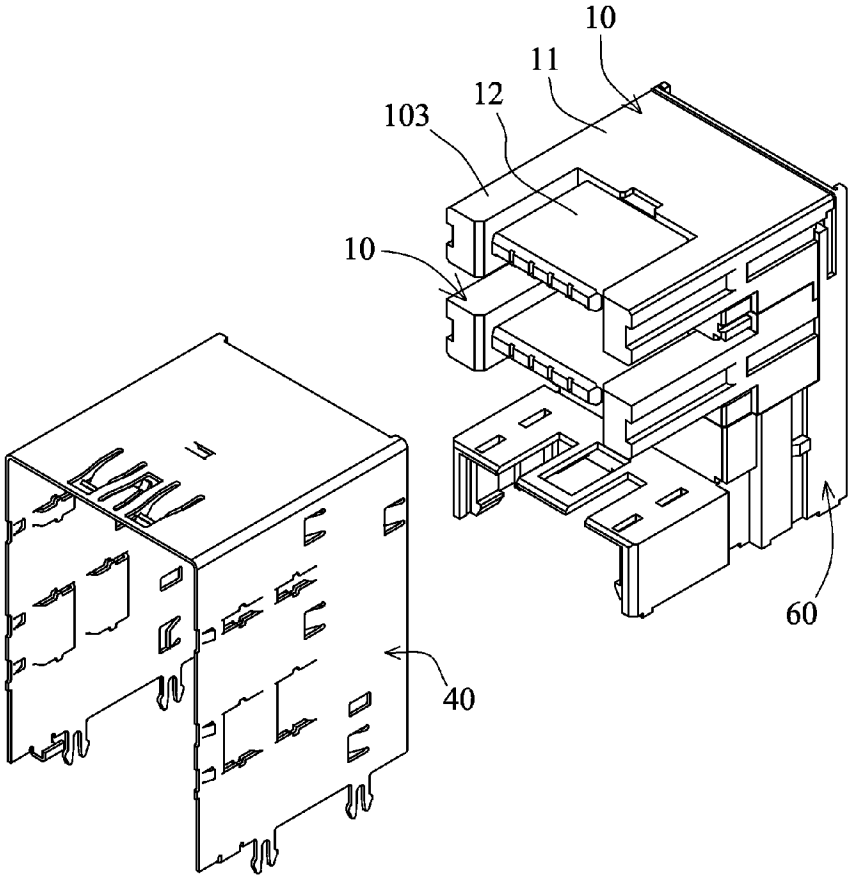
FIG. 52 is a pictorially exploded view of a $22^{th}$ embodiment of the invention.
Figure 53:
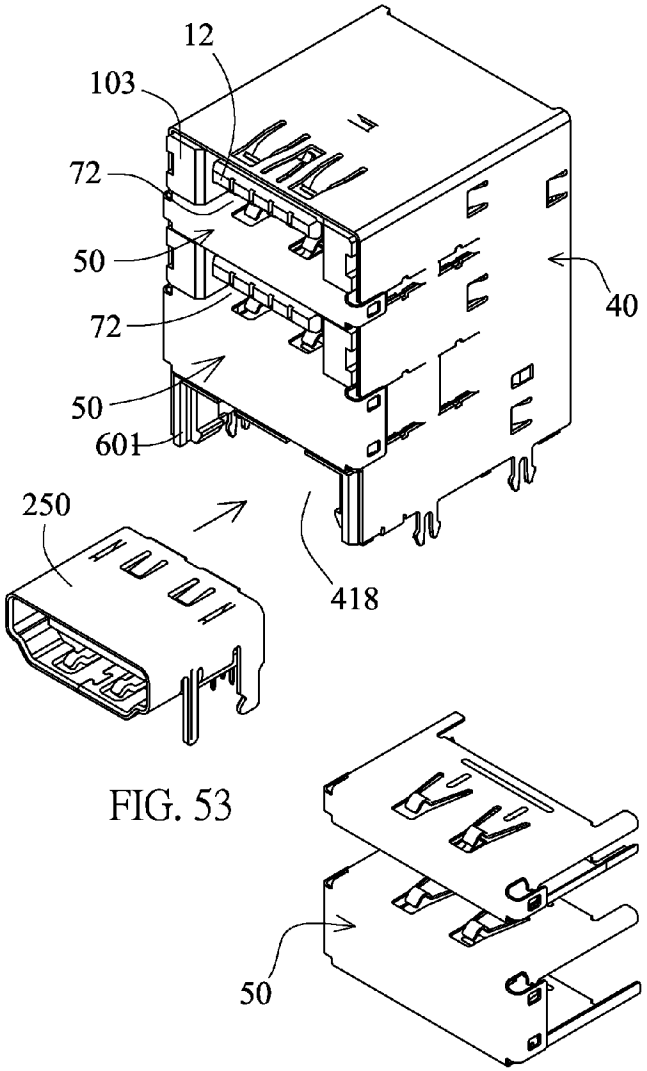
FIG. 53 is a pictorially assembled view of the $22^{th}$ embodiment of the invention.
Figure 55:
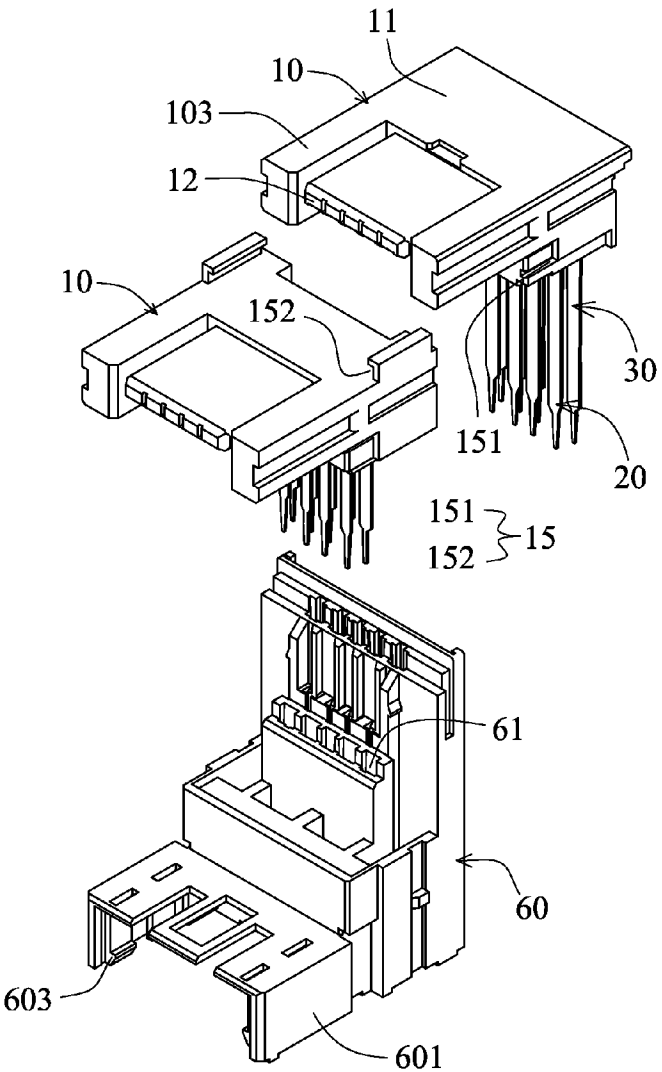
FIG. 55 is a partially pictorially exploded view of the $22^{th}$ embodiment of the invention.
Figure 54:
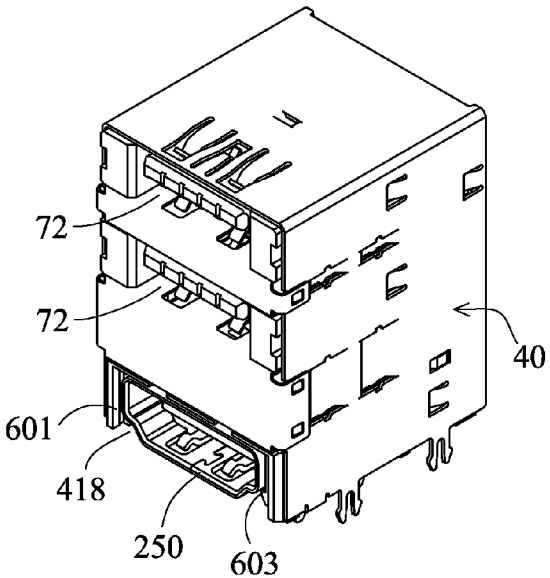
FIG. 54 is a pictorial view showing a used state of the $22^{th}$ embodiment of the invention.

As shown in FIGS. 52 and 53, the 22$^{nd}$ embodiment of the invention is substantially the same as the 16$^{th}$ embodiment except for the following differences. The bases 11 of the two insulating seats 10 integrally have two lateral portions 103 in the frontward direction. The two lateral portions 103 are disposed on two sides of the tongue 12, so that the width of each USB 3.0 connection slot 72 is smaller than that of the chamber 418 of the metal casing 40. In addition, the front end of the insulating rear cover 60 integrally has an inverse-U shaped frame 601. The inverse-U shaped frame 601 is disposed in the chamber 418, and engaging portions 603 in the form of hooks are disposed on the inner two sides of the inverse-U shaped frame 601, as shown in FIG. 54. When one HDMI socket 250 is placed in the chamber 418, it can be clamped by the inverse-U shape frame 601 and engaged with the engaging portions 603.

Figure 56:
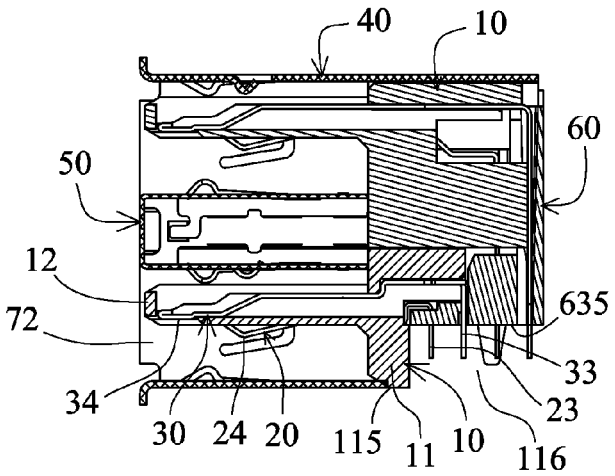
FIG. 56 is a cross-sectional side view of a $23^{rd}$ embodiment of the invention.

As shown in FIG. 56, the 23$^{rd}$ embodiment of the invention is a dual-layer board-sinking USB 3.0 socket having the vertically stacked structure, and is substantially the same as the second embodiment except for the following differences. A resting surface 635, which is higher than the bottom 115 of the bottommost insulating seat 10 is disposed below the rear sections of the two insulating seats 10. The resting surface 635 is the bottom surface of the insulating rear cover 60. A depression 116 is formed between the resting surface 635 and the bottom 115 of the bottommost insulating seat. The pins 23, 33 of the rows of terminals 20, 30 pass through the resting surface 635 and are disposed in the depression 116.

The contacts 24, 34 of the USB 3.0 contact interface face downwards and are connected forwardly. However, this invention may also be applied to the contacts of the USB 3.0 contact interface facing upwards and connected reversely.

With the above-mentioned structure, the resting surface 635 of the socket rests against and is disposed on a circuit board, so that the portion lower than the resting surface 635 is sunk below the circuit board and the socket with the vertically stacking structure can lower the height on the circuit board.

Figure 57:
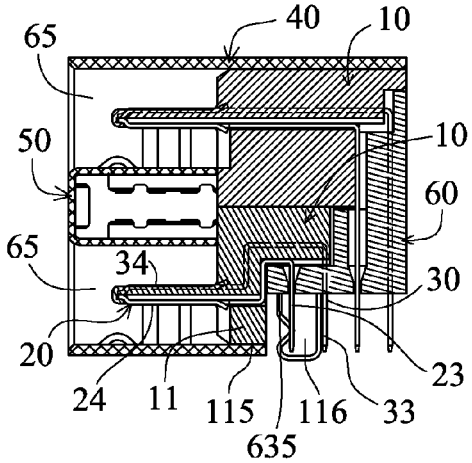
FIG. 57 is a cross-sectional side view of a $24^{th}$ embodiment of the invention.

As shown in FIG. 57, the 24$^{th}$ embodiment of the invention is substantially the same as the 23$^{rd}$ embodiment except that two HDMI connection slots 65 stacked vertically are provided.

Figure 58:
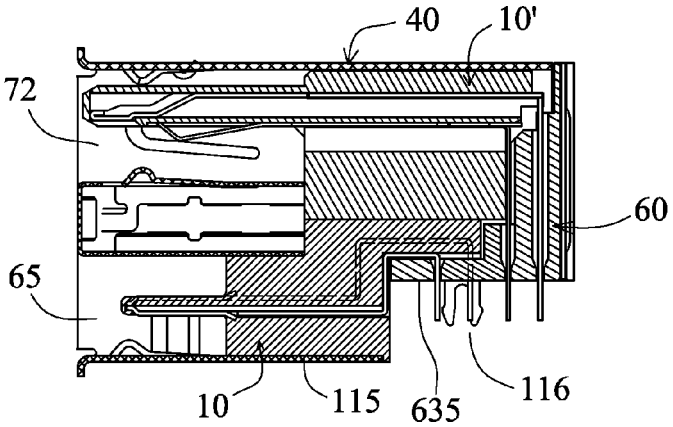
FIG. 58 is a cross-sectional side view of a $25^{th}$ embodiment of the invention.

As shown in FIG. 58, the 25$^{th}$ embodiment of the invention is substantially the same as the 23$^{rd}$ embodiment except that a USB 3.0 connection slot 72 and a HDMI connection slot 65 stacked vertically are provided.

Figure 61:
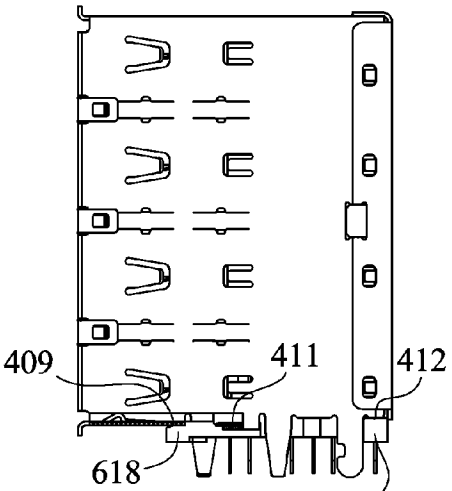
FIG. 61 is a side view of the $26^{th}$ embodiment of the invention.
Figure 59:
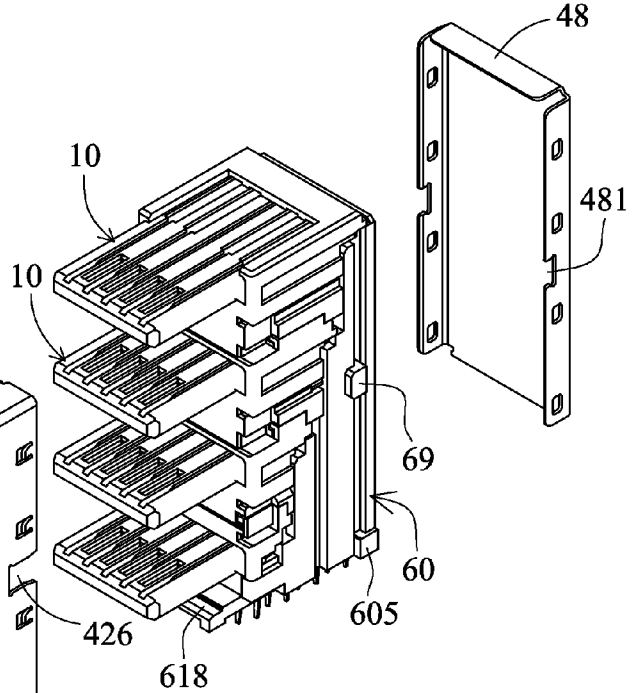
FIG. 59 is a pictorially exploded view of a $26^{th}$ embodiment of the invention.
Figure 60:
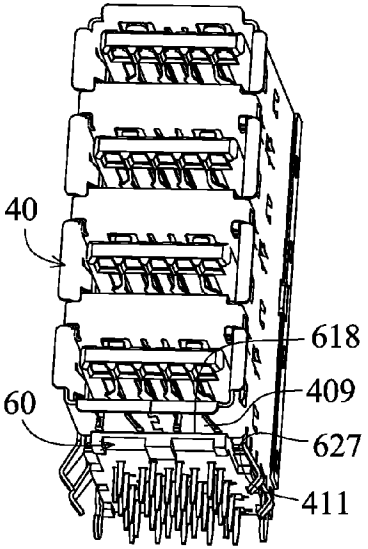
FIG. 60 is a pictorially assembled view of the $26^{th}$ embodiment of the invention.

As shown in FIGS. 59 to 61, the 26$^{th}$ embodiment of the invention is substantially the same as the second embodiment except for the following differences. Only a single insulating rear cover 60 is provided. The insulating rear cover 60 and the metal casing 40 rest against and position with each other, and a locking structure is formed therebetween to form the vertical engaging and stacking. The four vertically stacked insulating seats 10 are assembled on the insulating rear cover 60. The bottom surface of the insulating rear cover 60 is lower than the bottom surface of the bottommost insulating seat 10. The locking structure includes at least one engaging portion disposed on each of two sides of the rear ends of the insulating rear cover 60 and the metal casing 40. The engaging portion is the mutual locking structure formed by the engaging block 69 and the engagement hole 426. The bottoms of the insulating rear cover 60 and the metal casing 40 are formed with locking structures, which are parallel to and engage with the bottoms. That is, the bottom of the insulating rear cover projects frontwards to form a front base portion 618, each of two sides of the bottom of the insulating rear cover is formed with a groove 627, and each of two sides of the bottom rear end is formed with an engaging block 605. The front base portion 618 frontwardly projects beyond the bottom front end of the lower insulating seat 10, and rests against and is positioned below the bottom plate surface 409 of the metal casing 40. Each of the bottom ends of the two sides of the metal casing 40 is formed with an engaging sheet 411 engaging with the groove 627. The engaging blocks 605 on two sides of the bottom rear end of the insulating rear cover engage with the bottoms 412 on two sides of the rear end of the metal casing 40. The bottoms of the insulating rear cover 60 and the metal casing 40 are formed with the locking structure parallel to and engaging with the bottoms by that: (a) the front base portion 618 rests and is positioned below the bottom plate surface 409 of the metal casing 40; (b) the engaging sheet 411 of the metal casing 40 engages with the groove 627 of the insulating rear cover; and (c) the engaging block 605 of the insulating rear cover engages with the bottoms 412 on two sides of the rear end of the metal casing 40. The insulating rear cover 60 and the metal casing 40 can be assembled in the horizontal front-rear direction to form the engaging in the top-bottom and left-right directions.

Figure 64:
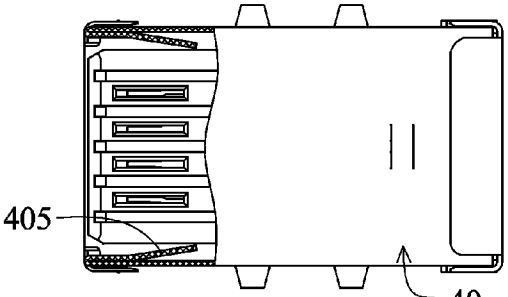
FIG. 64 is a cross-sectional top view of the $27^{th}$ embodiment of the invention.
Figure 63:
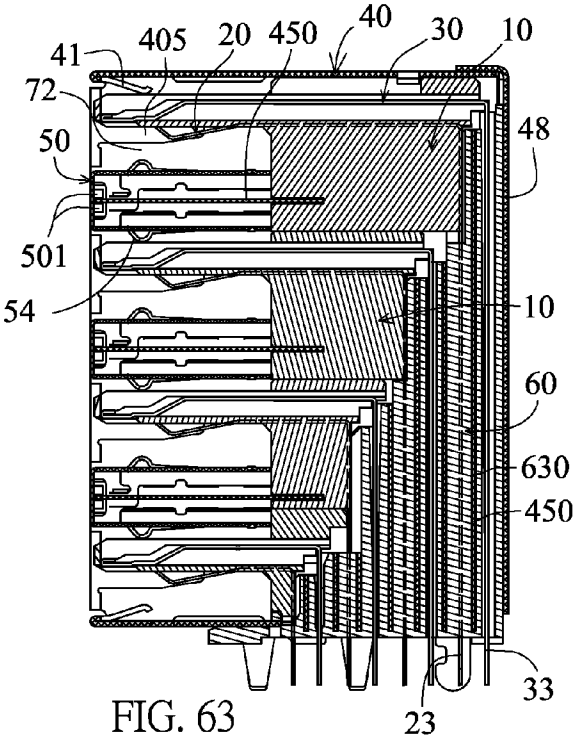
FIG. 63 is a cross-sectional side view of the $27^{th}$ embodiment of the invention.
Figure 62:
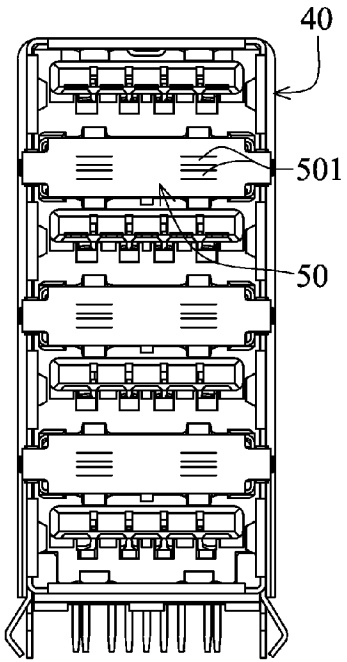
FIG. 62 is a front view of a $27^{th}$ embodiment of the invention.

As shown in FIGS. 62 to 64, the 27$^{th}$ embodiment of the invention is substantially the same as the 26$^{th}$ embodiment except for the following differences. The four USB 3.0 connection slots 72 are completely shielded by the metal surfaces. That is, the elastic snaps 41 of the top and bottom surfaces of the metal casing 40 are formed by reversely bending inwards from the inserting port in correspondence with the USB 3.0 connection slot 72, and are not formed by prodding the plate surface. In addition, the two side surfaces of the metal casing 40 are also formed by reversely bending inwards from the inserting port in correspondence with the elastic grounding sheet 405 of each USB 3.0 connection slot 72. Thus, the portion of the metal casing 40 corresponding to the USB 3.0 connection slot 72 has no punching hole prodded from the plate surface. In addition, a metal baffle 450 for separating the two side plates is disposed between the two side plates of the separating member 50. The metal baffle 450 has one end fixed to the insulating seat 10 and the other end engaged by the engaging portion 501 of the separating member 50. The separating member 50 can shield the punching holes for accommodating the elastic snaps 54 using the metal baffle 450. In addition, the insulating rear cover 60 has multiple vertically extending assembling slots 630, in which a vertically extending metal baffle 450 for separating the pins of two rows of neighboring terminals is assembled.

With the above-mentioned structure, this embodiment can achieve the better metal surface shielding effect, and is advantageous to the high-frequency high-speed transmission and the anti-electric interference.

Figure 65:
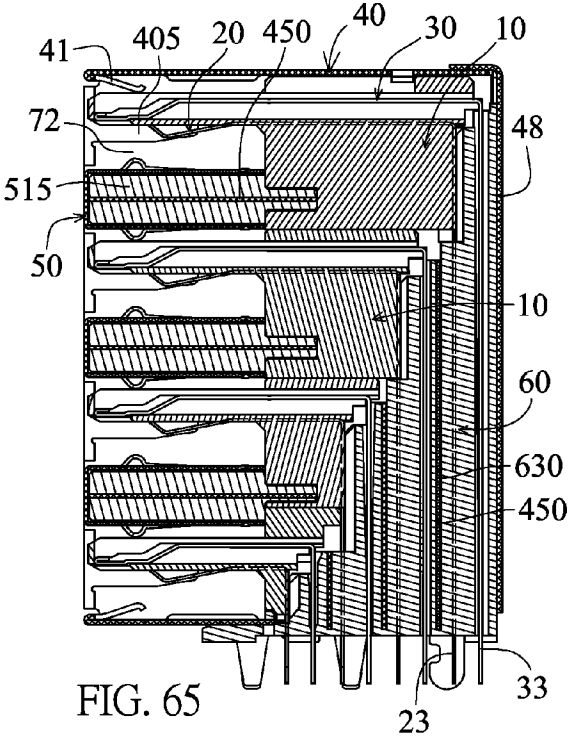
FIG. 65 is a cross-sectional side view of a $28^{th}$ embodiment of the invention.

As shown in FIG. 65, the 28$^{th}$ embodiment of the invention is substantially the same as the 27$^{th}$ embodiment except for the following differences. A middle holding plate 515 is assembled into each of the second to fourth layers of insulating seats 10. The separating member 50 is fit with the middle holding plate 515. A metal baffle 450 is disposed in the middle holding plate 515.

Figure 66:
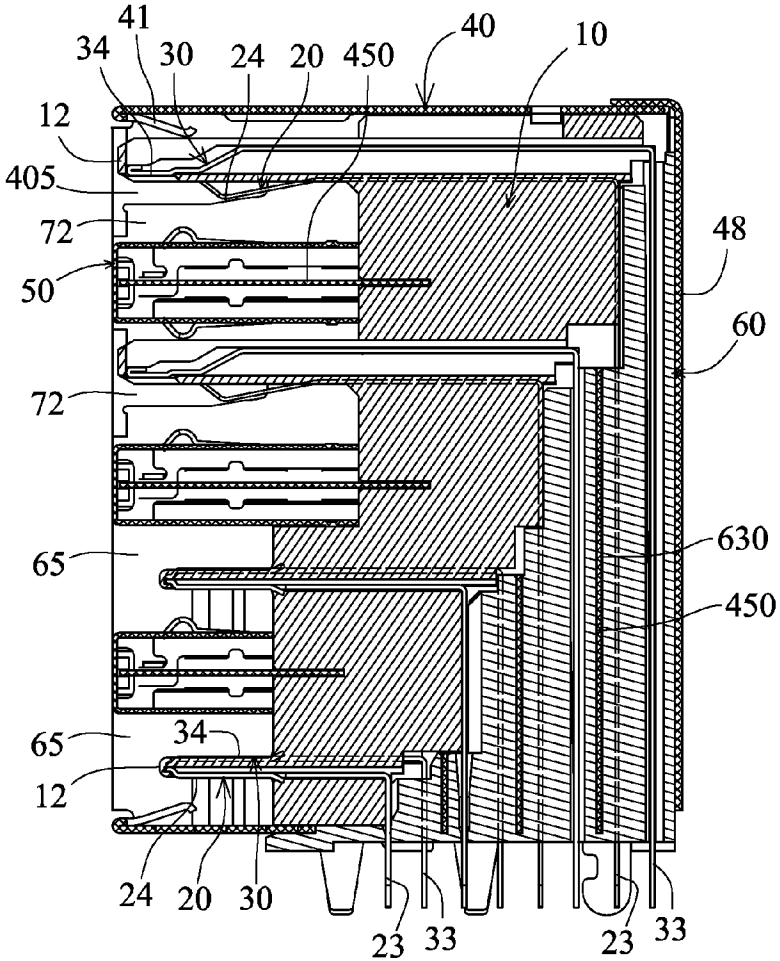
FIG. 66 is a cross-sectional side view of a $29^{th}$ embodiment of the invention.

As shown in FIG. 66, the 29$^{th}$ embodiment of the invention is substantially the same as the 27$^{th}$ embodiment except for the following differences. This embodiment has two USB 3.0 connection slots 72 and two HDMI connection slots 65, and only has a single insulating seat 10. The insulating seat 10 is integrally formed with two USB 3.0 tongues 12 and two HDMI tongues 12.

Figure 67:
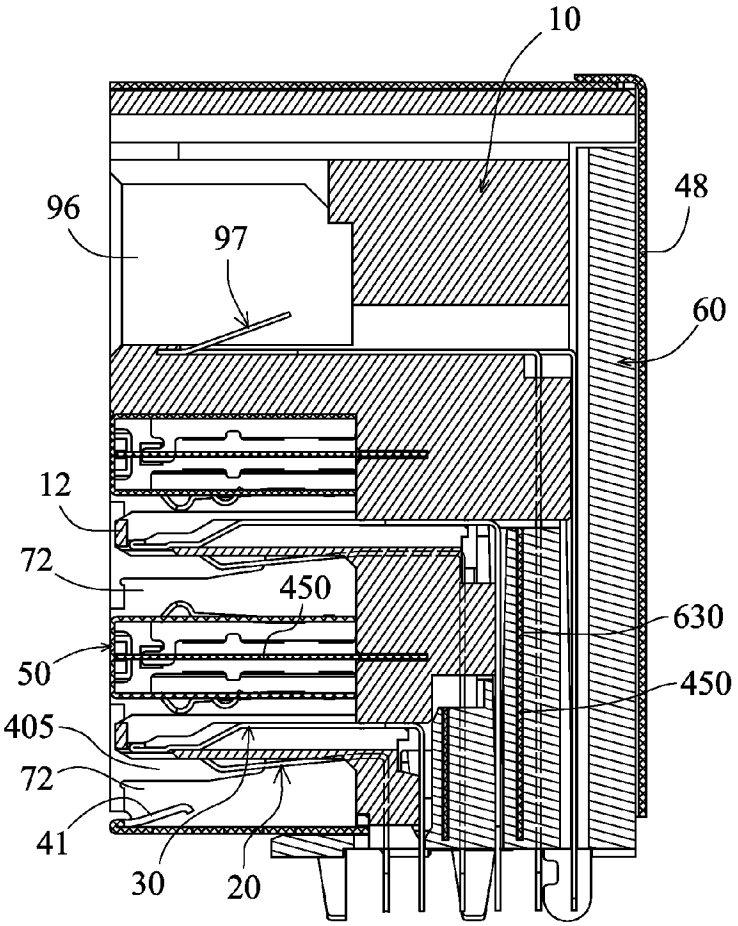
FIG. 67 is a cross-sectional side view of a $30^{th}$ embodiment of the invention.

As shown in FIG. 67, the 30$^{th}$ embodiment of the invention is substantially the same as the 29$^{th}$ embodiment except for the following differences. This embodiment has two USB 3.0 connection slots 72 and one RJ45 connection slot 96. The insulating seat 10 is integrally formed with two USB 3.0 tongues 12 and one RJ45 connection slot 96.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. An electrical connection socket, comprising:

at least two insulating seats each having a base, wherein at least one row of terminals is assembled in each of the at least two insulating seats, wherein the terminal has an extension, a fixing portion and a pin, the fixing portion is fixed to a corresponding one of the at least two insulating seats, the extension is connected to one end of the fixing portion and has a contact, the pin is connected to the fixing portion and extends out of the insulating seat, and the contacts of the at least one row of terminals form at least one contact interface, wherein one end of the base of at least one of the insulating seats is projected to form at least one tongue, the base is thicker than the tongue, the tongue has the at least one contact interface, and the bases of the at least two insulating seats are stacked and directly connected to each other;

a metal casing covering the at least two insulating seats, wherein one end of the metal casing is formed with an opening, and the metal casing directly rests against the at least two insulating seats; and at least two connection slots disposed in the metal casing, wherein the tongue is disposed in one of the connection slots, and the contact interface is disposed in each of the connection slots so that the contact interface is electrically connected to a plug, wherein an inserting port of the connection slot is exposed from the opening of the metal casing.

2. The electrical connection socket according to claim 1, wherein the metal casing is a metal plate bent to form integrally connected circumferential surfaces, and the metal plate is only connected and locked together on only one side to form a housing, wherein one end of the metal plate other than the circumferential surfaces is opened to form the opening.

3. The electrical connection socket according to claim 1, further comprising at least one separating member made of a metal material so that circumferential surfaces of the at least one of the connection slots are metal surfaces, wherein:

at least one surface of two opposite metal surfaces in the at least one of the connection slots integrally has an inwardly projecting elastic snap; or at least one surface of the two opposite metal surfaces in the at least one of the connection slots integrally has an inwardly projecting elastic grounding sheet.

4. The electrical connection socket according to claim 1, wherein each of the bases has a first surface and a second surface opposite to the first surface, one of the first surface and the second surface of the base is directly connected to the other base, and the first surface and the second surface of the base are integrally formed.

5. The electrical connection socket according to claim 1, further comprising at least one separating member, which is made of a metal material and separates the metal casing into at least two stacked spaces, wherein the separating member has a middle plate and two side plates to form a "U" shape.

6. The electrical connection socket according to claim 5, wherein at least one of the connection slots is formed by the at least one separating member and the metal casing.

7. The electrical connection socket according to claim 6, wherein at least one side surface of two opposite side surfaces of the metal casing has at least one inwardly projecting structure, and at least one side of the two sides of the two side plates of the separating member rests against the inwardly projecting structure so that the inwardly projecting structure is supported between the two side plates.

8. The electrical connection socket according to claim 7, wherein at least one side of each of the two side plates of the separating member has a bent portion, the bent portions are close to each other, the inwardly projecting structure has a hook portion hooking the bent portion to prevent the metal casing from expanding by an external force in a lateral direction.

9. Electrical connection socket according to claim 5, wherein at least two connection slots have different contact interfaces and different widths, and the separating members with different widths are disposed in the at least two connection slots.

10. Electrical connection socket according to claim 5, wherein:

at least one side of each of the two side plates of the separating member has a bent portion, the bent portions are close to each other, and the bent portions form corner edges for structure strengthening;

at least one side plate of the two side plates of the separating member has at least one outwardly projecting elastic snap;

a metal baffle for separating the two side plates is disposed between the two side plates of the separating member; or at least one side of the at least one side plate of the separating member has an inwardly inclined surface.

11. The electrical connection socket according to claim 1, further comprising at least one separating member for dividing the metal casing into at least two stacked spaces, the separating member has a middle plate and two side plates to form a "U" shape, each of the insulating seats has the tongue, and the at least two connection slots are formed by the at least one separating member and the metal casing.

12. The electrical connection socket according to claim 1, wherein the at least two connection slots have different contact interfaces and different widths, an external shape of the metal casing forms at least one step, so as to form the connection slots with different widths, or the metal casing has inward convex portions toward two sides of at least one connection slot to reduce an inner width of the connection slot.

13. The electrical connection socket according to claim 1, wherein the base of each of the at least two insulating seats has an engaging structure, which makes the stacked two insulating seats directly lock with each other, and the engaging structure is a locking structure of a slot and an engaging block.

14. The electrical connection socket according to claim 1, wherein:

the tongue of the insulating seat has one row of four first terminals, each having an extension which is vertically elastically movable, a contact projecting beyond one surface of the tongue, and a contact to form a USB 2.0 contact interface;

the tongue of the insulating seat has one row of four first terminals and one row of five second terminals, each of the one row of four first terminals has an extension, which is vertically elastically movable, and a contact projecting beyond one surface of the tongue, and each of the one row of five second terminals has an extension resting against the tongue and is not elastically movable, the contact of the second terminal and the contact of the first terminal are disposed on the same surface, and the contact of the second terminal is disposed in front of the contact of the first terminal, wherein the contacts of the one row of first terminals and the contacts of the second terminals form a USB 3.0 contact interface; or the tongue of the insulating seat has two rows of terminals each having a contact, which is not elastically movable, wherein the contacts of the two rows of terminals are exposed from two opposite surfaces of the tongue, respectively.

15. The electrical connection socket according to claim 1, further comprising at least one insulating rear cover resting against rear ends of the at least two insulating seats, wherein pins of the at least one row of terminals of the at least one of the insulating seats pass through the at least one insulating rear cover.

16. The electrical connection socket according to claim 15, wherein:

a vertically extending metal sheet is disposed and positioned on a backside of the insulating rear cover;

the insulating rear cover has at least one vertically extending metal baffle for separating the pins of neighboring two rows of the terminals; or a locking structure is disposed between the insulating rear cover and the metal casing to form locking in a vertical direction, wherein a bottom surface of the insulating rear cover is lower than a bottom surface of the at least one of the insulating seats.

17. The electrical connection socket according to claim 1, wherein the opening of the metal casing and the inserting ports of the at least two connection slots face frontwards, the metal casing is a metal plate integrally bent into left, right and top surfaces and a front end opened to form the opening, a bottom end of the metal casing is opened and is a raised housing, and an internal bottommost section of the metal casing is formed with an accommodating space, which is disposed below the at least two connection slots and can accommodate another electrical connection socket.

18. The electrical connection socket according to claim 1, wherein the at least two insulating seats are stacked vertically, a resting surface, which is higher than a bottom of the bottommost insulating seat, is disposed below rear sections of the at least two insulating seats, a depression is formed between the resting surface and the bottom of the bottommost insulating seat, and the pins of the at least two rows of terminals pass through the resting surface.

19. The electrical connection socket according to claim 1, wherein:

the at least two contact interfaces comprise at least two different contact interfaces to be electrically connected to at least two different plugs; or the at least two connection slots comprise at least two different frame shapes, and the connection slots with the different frame shapes have different contact interfaces to be electrically connected to at least two different shapes of plugs, respectively.

20. The electrical connection socket according to claim 1, wherein:

the at least one contact interface is disposed in each of the insulating seats; or each of the at least two insulating seats has the at least one tongue.

* * * * *